US010510244B2

(12) United States Patent
Witkowski et al.

(10) Patent No.: US 10,510,244 B2
(45) Date of Patent: Dec. 17, 2019

(54) SELECTIVE TRANSMISSION OF COMMANDS ASSOCIATED WITH A SINGLE TRANSCEIVER CHANNEL

(71) Applicant: Gentex Corporation, Zeeland, MI (US)

(72) Inventors: Todd R. Witkowski, Zeeland, MI (US); Thomas D. Klaver, Ada, MI (US); Kelly S. Harrelson, Holland, MI (US); Steven L. Willard, II, Holland, MI (US); Kevin J. Key, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/888,830

(22) Filed: Feb. 5, 2018

(65) Prior Publication Data

US 2018/0225959 A1 Aug. 9, 2018

Related U.S. Application Data

(60) Provisional application No. 62/455,297, filed on Feb. 6, 2017.

(51) Int. Cl.
*G08C 17/02* (2006.01)
*G07C 9/00* (2006.01)

(52) U.S. Cl.
CPC ..... *G08C 17/02* (2013.01); *G07C 9/00309* (2013.01); *G07C 2009/00865* (2013.01);
(Continued)

(58) Field of Classification Search
CPC ..... G08C 17/02; G08C 2201/20; G08C 2201/91; G07C 9/00309; G07C 2009/00865; G07C 2009/00928
See application file for complete search history.

(56) References Cited

U.S. PATENT DOCUMENTS

2006/0206242 A1* 9/2006 Robillard ..... G01C 21/26 701/1
2006/0226949 A1* 10/2006 Reene ..... B60R 25/24 340/5.25

(Continued)

OTHER PUBLICATIONS

International Searching Authority, International Search Report and Written Opinion for International Application No. PCT/US 2018/016873, dated Feb. 5, 2018, 6 pages.

(Continued)

*Primary Examiner* — Thomas D Alunkal
(74) *Attorney, Agent, or Firm* — Foley & Lardner LL; Bradley D. Johnson

(57) ABSTRACT

The present disclosure is directed to systems and methods of selectively transmitting commands associated with a single channel. A trainable transceiver may include a channel, an electronic display, and a container element. The channel may be trained to control one or more functions of the remote device. The electronic display may display one or more container elements. The container element of the electronic display may include a first soft key and a second soft key. The container element may be associated with the channel. The first soft key may control a first function of the remote device. The second soft key may control a second function of the remote device.

20 Claims, 12 Drawing Sheets

(52) U.S. Cl.
CPC ..... *G07C 2009/00928* (2013.01); *G08C 2201/20* (2013.01); *G08C 2201/91* (2013.01)

(56) References Cited

U.S. PATENT DOCUMENTS

| | | | | |
|---|---|---|---|---|
| 2007/0080845 | A1 | 4/2007 | Amand | |
| 2008/0068205 | A1* | 3/2008 | Witkowski | B60R 25/24 340/4.3 |
| 2010/0134240 | A1* | 6/2010 | Sims | G08C 17/02 340/5.1 |
| 2014/0118119 | A1* | 5/2014 | Geerlings | G07C 9/00309 340/12.5 |
| 2015/0137941 | A1* | 5/2015 | Bauer | G07C 9/00007 340/5.61 |
| 2015/0364033 | A1* | 12/2015 | Witkowski | G08C 17/02 340/5.25 |
| 2016/0203721 | A1* | 7/2016 | Wright | H04N 7/18 348/118 |

OTHER PUBLICATIONS

International Preliminary Report of Patentability dated Aug. 8, 2019, for corresponding PCT application No. PCT/US2018/016873, 5 pages.

Extended European Search Report dated Sep. 9, 2019, for corresponding European application No. 187483607, 8 pages.

* cited by examiner

SELECTIVE TRANSMISSION OF COMMANDS ASSOCIATED WITH A SINGLE TRANSCEIVER CHANNEL

CROSS-REFERENCES TO RELATED APPLICATIONS

This application claims the benefit and priority under 35 U.S.C. § 119(e) to U.S. Provisional Patent Application No. 62/455,297, titled "SELECTIVE TRANSMISSION OF COMMANDS ASSOCIATED WITH A SINGLE TRANSCEIVER CHANNEL," filed Feb. 6, 2017, which is hereby incorporated by reference in its entirety.

TECHNICAL FIELD

The present disclosure relates generally to the field of transceivers for controlling remote electronic devices.

BACKGROUND

A transceiver may transmit various signals to control one of the functions of a remote electronic device (e.g., a garage door opener). The transceiver may have physical buttons for determining which signal to transmit to the remote electronic device based on how long the physical button is pressed. For example, the transceiver may transmit a first control signal, while the physical button is pressed for the first five seconds, and transmit a second control signal, if the physical button is pressed for longer than five seconds. In some cases, the transceiver may transmit interleaved signals, sending a first signal and then a second signal repeatedly. This configuration may result in the transceiver sending a signal different from the one that the operator of the transceiver had intended. Another problem may be that the different functions of the remote electronic are assigned to separate physical buttons on the transceiver, resulting in fewer buttons available to control multiple remote electronic devices.

SUMMARY

One embodiment of the present disclosure relates to a trainable transceiver for selectively transmitting commands associated with a single channel. The trainable transceiver includes a channel, an electronic display, and a container element. The channel is trained to control one or more functions of a remote device. The electronic display displays one or more container elements. The container element of the electronic display includes a first soft key and a second soft key. The container element is associated with the channel. The first soft key controls a first function of the remote device. The second soft key controls a second function of the remote device.

Another embodiment of the present disclosure relates to a method of selectively transmitting commands associated with a single channel. A trainable transceiver trains, using a first control signal from the remote device, a first channel of the trainable transceiver to a first function of a remote device. The first channel corresponds to a first container element on the trainable transceiver. The trainable transceiver trains, using a second control signal from the remote device, a second channel of the trainable transceiver to a second function of the remote device. The second channel corresponds to a second container element on the trainable transceiver. The second container element is different from the first container element. The trainable transceiver detects that a first signal characteristic of the first control signal is similar to a second signal characteristic of the second control signal. The trainable transceiver sets the first function and the second function to the first channel, responsive to detecting that the first signal characteristic of the first control signal is similar to the second signal characteristic of the second control signal.

Another embodiment of the present disclosure relates to a method of selectively transmitting commands associated with a single channel. A trainable transceiver identifies a first channel of the trainable transceiver as set to transmit a first control signal for a first function of the remote device. The first channel corresponds to a first container element on the trainable transceiver. The trainable transceiver trains, using a second signal from the remote device, the first channel of the trainable transceiver to a second function of the remote device. The trainable transceiver determines that the first channel is trained to the first function. The trainable transceiver detects that a first signal characteristic of the first control signal is similar to a second signal characteristic of the second control signal, responsive to determining that the first channel is trained to the first control signal. The trainable transceiver sets the first function and the second function to the first channel, responsive to determining that the first signal characteristic of the first control signal is similar to the second signal characteristic of the second control signal.

Alternative exemplary embodiments relate to other features and combinations of features as may be generally recited in the claims.

DETAILED DESCRIPTION

Figure 1:
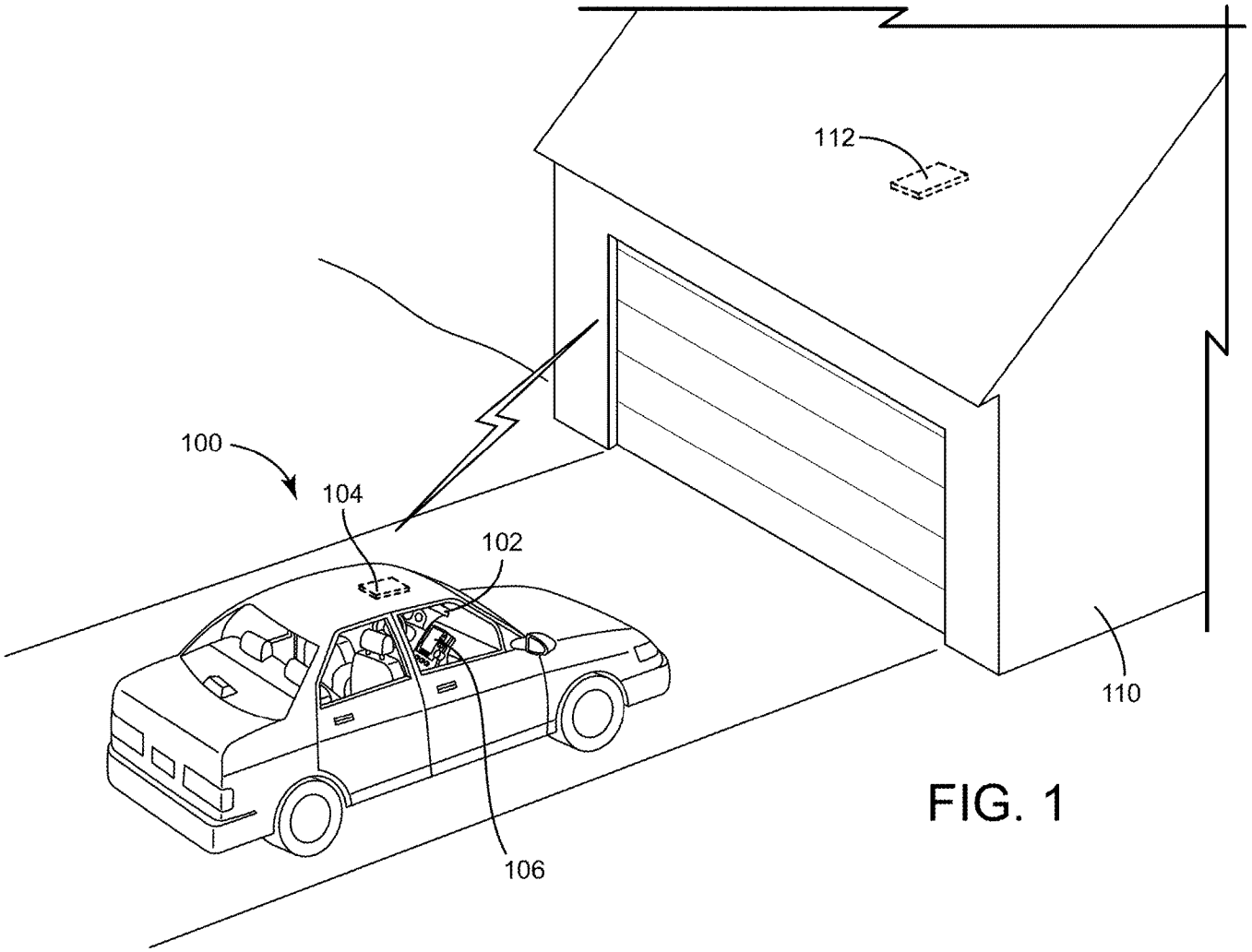
FIG. 1 is a perspective view of a vehicle having a trainable transceiver for operating a garage door after authenticating user.

Referring generally to the FIGURES, systems, apparatuses, and methods are shown and described for allowing a trainable transceiver to selectively transmit commands associated with a single channel. A trainable transceiver may transmit various signals to control or actuate one of the functions at a remote electronic device (e.g., opening or closing a door). This disclosure allows for the trainable transceiver to assign or set multiple commands to a single channel to control the function of a remote electronic device. In one embodiment, the trainable transceiver may include a reconfigurable electronic display with a user interface including container elements with soft keys. The trainable transceiver may be trained to control multiple functions of the remote electronic device. While training, the trainable transceiver may determine that the remote electronic device utilizes multiple command codes (e.g., lock, unlock, activate, and enroll/pair). Upon the determination, the trainable transceiver may associate the multiple codes into a single channel. In addition, the user interface on the reconfigurable electronic display may display a prompt for assigning functions of the remote electronic device to one of the soft keys on the display. The trainable transceiver may also remove soft keys from display, if determined to be no longer pertinent or needed (e.g., pair command after pairing the trainable transceiver with the remote electronic device). In this manner, clear indications as to which function is associated with the soft key on the user interface of the trainable transceiver may reduce the likelihood that a command different from the one the operator of the trainable transceiver had intended will be sent. Moreover, associating multiple commands with a single channel of the trainable transceiver, instead of different channels, may free up other channels for other uses (e.g., controlling a different remote electronic devices).

With respect to trainable transceivers for controlling home electronics device and/or remote devices in general, home electronic devices may include devices such as a garage door opener, gate opener, lights, security system, and/or other device which is configured to receive activation signals and/or control signals. A home electronic device need not be associated with a residence but can also include devices associated with businesses, government buildings or locations, or other fixed locations. Remote devices may include mobile computing devices such as mobile phones, smartphones, tablets, laptops, computing hardware in other vehicles, and/or other devices configured to receive activation signals and/or control signals.

Activation signals may be wired or, preferably, wireless signals transmitted to a home electronic device and/or remote device. Activation signals may include control signals, control data, encryption information (e.g., a rolling code, rolling code seed, look ahead codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver used to send activation signals and/or other information to home electronic devices and/or remote devices. The same wireless transmission scheme, protocol, and/or hardware may be used for transmitting and receiving. The trainable transceiver may have a two way communication with home electronic devices and/or remote devices. In other embodiments, the trainable transceiver includes additional hardware for two way communication with devices and/or receiving information from devices. In some embodiments, the trainable transceiver has only one way communication with a home electronic device. The trainable transceiver may receive information about the home electronic device from a remote device in a separate communication. The information about the home electronic device and/or remote device may be received from an intermediary device such as an additional remote device and/or mobile communication device.

A trainable transceiver may also receive information from and/or transmit information to other devices configured to communicate with the trainable transceiver. For example, a trainable transceiver may receive information from cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as a global positioning system or other navigation devices, laptops, personal computers, and/or other devices. In still further embodiments, the trainable transceiver is configured to communicate with networking equipment such as routers, servers, switches, and/or other hardware for enabling network communication. The network may be the internet and/or a cloud architecture.

The trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz), although other frequencies may be used. In other embodiments, a trainable transceiver may include additional hardware for transmitting and/or receiving signals (e.g., activation signals and/or signals for transmitting and/or receiving other information). For example, a trainable transceiver may include a light sensor and/or light emitting element, a microphone and/or speaker, a cellular transceiver, an infrared transceiver, or another communication device.

The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and detect the control information of the received signal. In some embodiments, an original transmitter is a transmitter produced by the manufacturer of home electronics device, remote device, or other device for use specifically with the corresponding device. For example, an original transmitter may be a transmitter which is sold separately from a home electronics device, remote device, or other device but is intended to work with that device. The original transmitter may be a transmitter or transceiver that is part of a retrofit kit to add functions to an existing home electronics device, remote device, or other device. An original transmitter may be a transmitter or transceiver that is not manufactured by or under license from the manufacturer or owner of a home electronics device, remote device, or other device.

Referring to FIG. 1, a perspective view of a vehicle 100 and garage 110 is shown, according to an exemplary embodiment. Vehicle 100 may be an automobile, truck, sport vehicle, or other vehicle. Vehicle 100 is shown to include a trainable transceiver unit 102. In some embodiments, trainable transceiver unit 102 may be integrated with a mirror assembly (e.g., a rear view mirror assembly) of vehicle 100. In other embodiments, trainable transceiver unit 102 may be mounted to other vehicle interior elements, such as a vehicle headliner 104, a center stack 106, a visor, an instrument panel, or other control unit within vehicle 100.

Trainable transceiver unit 102 is configured to communicate with a remote electronic system 112 of a garage 110 or other structure. In some embodiments, remote electronic system 112 is configured to control operation of a garage door attached to garage 110. In other embodiments, remote electronic system 112 may be a home lighting system, a home security system, a data network (e.g., using ASK, using OOK, using FSK, LAN, WAN, cellular, etc.), a HVAC system, or any other remote electronic system capable of receiving control signals from trainable transceiver unit 102.

Trainable transceiver unit 102 is configured to reduce a duty cycle of a received activation signal relative and increase radio frequency power of subsequent transmissions of activation signals based on the received activation signal, while maintaining, an average radio frequency power over a predetermined amount of time below a predetermined limit. This provides an advantage in that trainable transceiver unit 102 has a greater range allowing for users in vehicle 100 to control remote electronic systems 112 (e.g., a garage door opener) from a greater distance.

Figure 2:
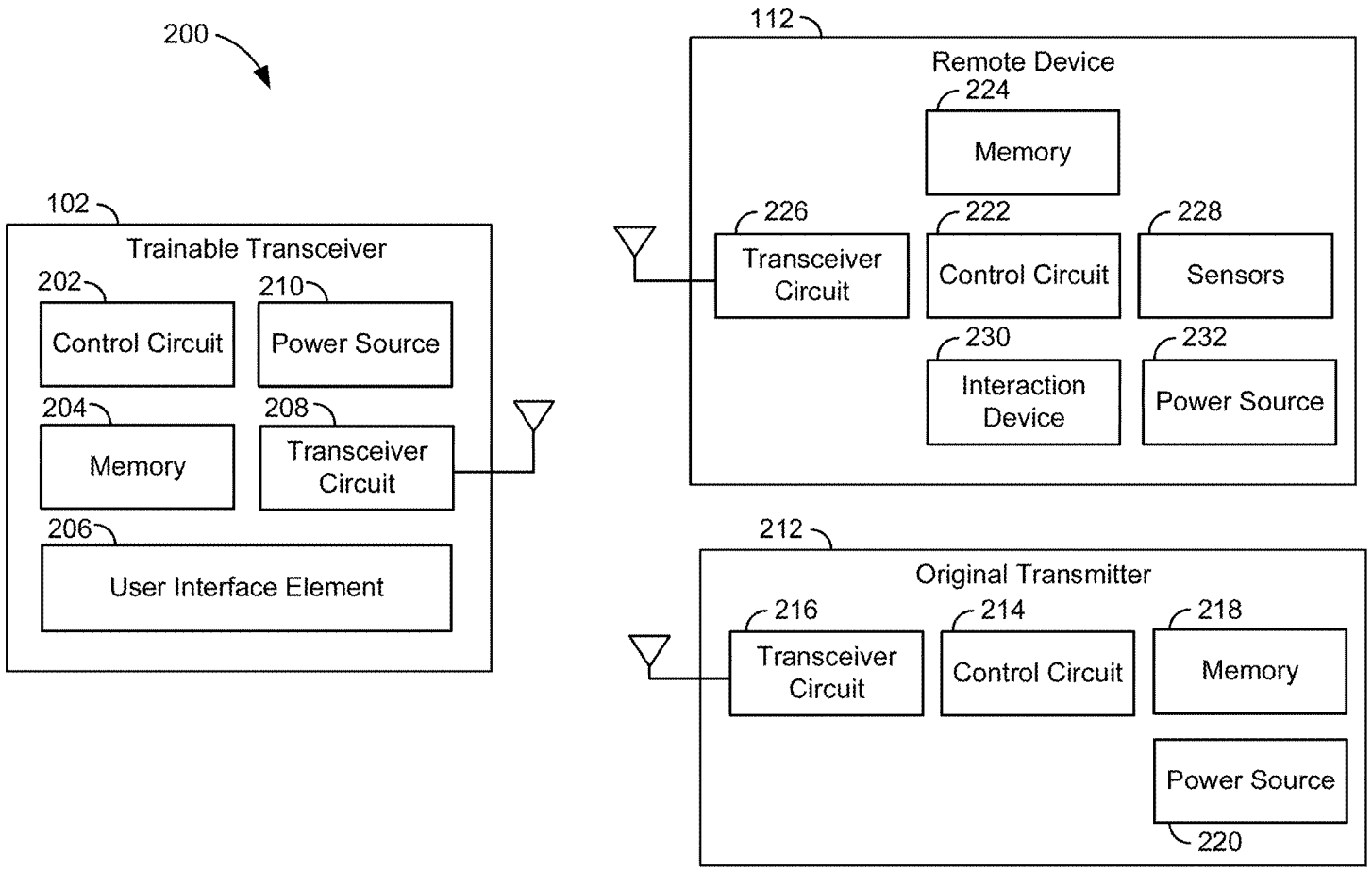
FIG. 2 is a block diagram of a trainable transceiver and the external devices with which the trainable transceiver can communicate, according to an illustrative embodiment.

Referring now to FIG. 2, a block diagram of the trainable transceiver 102, remote device 112, and an original transmitter 212 are shown, according to an illustrative embodiment. In overview, the trainable transceiver 102 may include a control circuit 202, memory 204, a user interface element 206, a transceiver circuit 208, and a power source 210, among other components. The remote device 112 may include a control circuit 222, memory 224, a transceiver circuit 222, a sensor 238, an interaction device 230, and a power source 232. The original transmitter 212 may include a control circuit 214, a transceiver circuit 216, memory 218, and a power source 220.

The control circuit 202 of the trainable transceiver 102 may be configured to receive inputs from the user interface element 206. In response to inputs from the user interface element 206, the control circuit 202 may cause the transceiver circuit 208 to transmit an activation signal, control signal, and/or other signal. The control circuit 202 may use information in memory 204 in order to cause the transceiver circuit 208 to format a signal for reception by a particular home electronics device or remote device 112. For example, memory 204 may include an identifier of the device, encryption information, frequencies for use in transmitting to the device, and/or other information.

The control circuit 202 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 202 may be a system on a chip (SoC) individually or with additional hardware components described herein. The control circuit 202 may further include, in some embodiments, memory 204 (e.g., random access memory, read only memory, flash memory, hard disk storage, flash memory storage, solid state drive memory, etc.). In further embodiments, the control circuit 202 may function as a controller for one or more hardware components included in the trainable transceiver. For example, the control circuit 202 may function as a controller for a touchscreen display (e.g., user interface element 206) or other operator input device, a controller for a transceiver, transmitter, receiver, or other communication device (e.g., implement a Bluetooth communications protocol).

The control circuit 202 may be coupled to memory 204. The memory 204 may be used to facilitate the functions of the trainable transceiver 102 described herein. Memory 204 may be volatile and/or non-volatile memory. For example, memory 204 may be random access memory, read only memory, flash memory, hard disk storage, flash memory storage, solid state drive memory, etc. In some embodiments, the control circuit 202 may read and write to memory 204. Memory 204 may include computer code modules, data, computer instructions, or other information which may be executed by the control circuit or otherwise facilitate the functions of the trainable transceiver described herein. For example, memory 204 may include encryption codes, pairing information, identification information, a device registry, etc. Memory 204 may include computer instructions, codes, programs, functions, data sets, and/or other information which are used to implement the algorithms described herein.

The control circuit 202 may also receive inputs via the user interface element 206 and in response place the trainable transceiver into a training mode. While in the training mode, an activation signal transmitted by the original transmitter 212 may be received by the transceiver circuit 208 of the trainable transceiver 102. The control circuit 202 of the trainable transceiver 102 may store one or more characteristics of the received activation signal in memory 204 for use in formatting control signals to be sent using the transceiver circuit 208. For example, stored characteristics may include, information identifying a home electronics device or remote device 112, encryption information, frequency, and/or other characteristics of the activation signal sent by the original transmitter 212 and received by the transceiver circuit 208 of the trainable transceiver. 102. In some embodiments, the control circuit 202 may cause the user interface element 206 to provide an output (e.g., illuminate an LED) when the signal from the original transmitter 212 is received and one or more characteristics are stored in memory 204.

The transceiver circuit 208 allows the trainable transceiver 102 to transmit and/or receive wireless communication signals. Wireless communication signals may be or include activation signals, control signals, activation signal parameters, status information, notifications, diagnostic information, training information, instructions, and/or other information. The wireless communication signals may be transmitted to or received from a variety of wireless devices (e.g., an original transmitter, home electronic device, mobile communications device, and/or remote device). The transceiver circuit 208 may be controlled by the control circuit 202. For example, the control circuit 202 may turn on or off the transceiver 208, the control circuit 202 may send data using the transceiver 208, format information, an activation signal, control signal, and/or other signal or data for transmission via the transceiver circuit 208, or otherwise control the transceiver circuit 208. In some embodiments, the transceiver circuit 208 may include additional hardware such as processors, memory, integrated circuits, antennas, etc. The transceiver circuit 208 may process information prior to transmission or upon reception and prior to passing the information to the control circuit 202. In some embodiments, the transceiver circuit 208 may be coupled directly to memory 204 (e.g., to store encryption data, retrieve encryption data, etc.).

The trainable transceiver 102 includes a transceiver circuit 208 and/or one or more antennas included in or coupled to the transceiver circuit 208. The antenna(s) may be located in the same housing and/or same location as other components of the trainable transceiver 102 (e.g., the transceiver circuit 208, control circuit, operator input device, and/or other components). In alternative embodiments, the antenna(s) are located remotely from one or more components of the trainable transceiver 102. The antenna(s) may be coupled to other components of the trainable transceiver 102 (e.g., transceiver circuit 208, control circuit, power source, and/or other components) via a wired or wireless connection. For example, the antenna and/or transceiver circuit 208 may be located remotely from the operator input device and control circuit with the control circuit in wireless communication with the transceiver circuit 208 via the antenna coupled to the transceiver circuit 208 and a second antenna coupled to the control circuit. The antenna may be one or a combination of a variety of antenna types. For example, the antenna may be or include a dipole antenna, loop antenna, slot antenna, parabolic reflector, horn, monopole, helical, and/or other type of antenna. The antenna may be omnidirectional, weakly directional, or directional. The antenna(s) and/or transceiver circuit 208 may be used to retrieve image data from one or more sources. The antenna(s) and/or transceiver circuit 208 may further be used for controlling a home electronics device, remote device 112, or other device (e.g., by sending an activation signal formatted by the control circuit and/or transceiver circuit 208 to control the device).

The transceiver circuit 208 may include one or more transceivers, transmitters, receivers, etc. For example, the transceiver circuit 208 may include an optical transceiver, near field communication (NFC) transceiver, etc. In some embodiments, the transceiver 208 may be implemented as a system on a chip. The transceiver circuit 208 may be used to format and/or send activation signals to a device, causing the device to take an action and/or otherwise allows communication with the device. The activation signal may include activation signal parameters and/or other information. The transceiver circuit 208 may be or include a radio frequency transceiver (e.g., a transceiver which sends or receives wireless transmission using radio frequency electromagnetic radiation). For example, the transceiver circuit 208 and/or control circuit 202 may modulate radio waves to encode information onto radio frequency electromagnetic radiation produced by the transceiver circuit 208 and/or demodulate radio frequency electromagnetic radiation received by the transceiver circuit 208.

The transceiver circuit 208 may include additional hardware such as one or more antennas, voltage controlled oscillator circuitry, amplifiers, filters, antenna tuning circuitry, volt meters, and/or other circuitry for the generation of and/or reception of modulated radio waves of different frequencies. The transceiver circuit 208 may provide for the functions described herein using techniques such as modulation, encoding of data onto a carrier wave, decoding data from a modulated carrier wave, signal strength detection, (e.g., computing and/or measuring voltage per length received by an antenna), antenna power regulation, and/or other functions related to the generation of and/or reception of radio waves. For example, the transceiver circuit 208 may be used to generate a carrier wave and encode onto the carrier wave (e.g., through modulation of the carrier wave such as frequency modulation or amplitude modulation) information such as control data, activation signal parameters, an encryption code (e.g., rolling code value), and/or other information. The transceiver circuit 208 may also be used to receive carrier waves and demodulate information contained within the carrier wave. The trainable transceiver 102 may be tuned (e.g., through antenna tuning) or otherwise controlled to send and/or receive radio waves (e.g., modulated carrier waves) at certain frequencies or channels and/or with a certain bandwidth.

The user interface element 206 may include a series of buttons and an illuminable logo, design, light, or other feature. Each button may be trained to operate a different home electronics device and/or remote device 112 using one or more of the training procedures described herein. The illuminable feature of the user interface element 206 may be used to communicate information to the user of the trainable transceiver 102. The user interface element 206 may include a display, one or more LEDs, a speaker, and/or other output devices for providing an output to a vehicle occupant. In some embodiments, the user inter face element 206 may include a reconfigurable electronic display that may be touch-sensitive. The output may convey information to the vehicle occupant regarding the position of the vehicle within a garage, structure, and/or designated parking area.

The user interface element 206 may be located remotely from one or more other components of the trainable transceiver 102 in some embodiments. For example, in embodiments in which the trainable transceiver 102 is installed in or otherwise integrated with a vehicle, the user interface element 206 may be located within the cabin of the vehicle, and one or more other components of the trainable transceiver 102 may be located in other locations (e.g., in an engine bay, in a trunk, behind or within a dashboard, in a headliner, elsewhere in the cabin and/or in other locations). This may allow for installation of the trainable transceiver 102, including the antenna, in a variety of locations and/or orientations. Advantageously, this may allow for the antenna(s) of the trainable transceiver 102 to be installed, mounted, or otherwise located in or on the vehicle in a position with less interference from vehicle structural components. The user interface element 206 and other components of the trainable transceiver 102 maybe in unidirectional or bidirectional communication with each other. The user interface element 206 may communicate via wire or wirelessly with the remaining components of the trainable transceiver 102 in some embodiments. In some embodiments, the user interface element 206 may be connected via a wire with the remaining components of the trainable transceiver 102. In some embodiments, the user interface element 206 may include a transceiver for transmitting signals corresponding to inputs received and for receiving status or other information to be conveyed to a vehicle occupant. The user interface element 206 may include a wireless transceiver (e.g., WiFi transceiver, Bluetooth transceiver, optical transceiver, and/or other transceiver) configured to communicate with the other components using the transceiver circuit 208 and/or a second transceiver (e.g., WiFi transceiver, Bluetooth transceiver, optical transceiver, and/or other transceiver) located with the other components remote from the operator input device. Communication between the trainable transceiver 102 and the operator input device may be carried out using one or more wireless communication protocols (e.g., a Bluetooth protocol, WiFi protocol, ZigBee protocol, or other protocol). The other components of the trainable transceiver 102 may communicate with the operator input device using the transceiver circuit 208 and/or a secondary or other transceiver (e.g., a Bluetooth transceiver).

The trainable transceiver 102 may communicate with original transmitters 212, home electronic devices 112, remote devices, mobile communications devices, network devices, and/or other devices as described above using the transceiver circuit 208 and/or other additional transceiver circuits or hardware. The devices with which the trainable transceiver 102 communicates may include transceivers, transmitters, and/or receivers. The communication may be one-way or two-way communication.

The power source 210 may also be included in the trainable transceiver 102 in some embodiments. The control circuit 202 may control the power source 210 such that the antenna and/or transceiver circuit 208 is provided with an amount of power determined based on the orientation of the trainable transceiver 102. In one embodiment, the power source 210 may be or may include a vehicle power system. For example, the power source may be a vehicle power system including a battery, alternator or generator, power regulating equipment, and/or other electrical power equipment. In further embodiments, the power source 210 may include components such as a battery, capacitor, solar cell, and/or other power generation or storage equipment.

The trainable transceiver 102 may be configured to be trained to control a home electronics device and/or remote device, such as the remote device 112. A home electronics device and/or remote device 112 may be any remotely controlled device. Examples of home electronics device and/or remote devices 112 may include garage door openers, lighting control systems, movable barrier systems (e.g., motorized gates, road barriers, etc.), multimedia systems, and/or other systems controllable by an activation signal and/or control signal. Home electronics devices and/or remote devices may include an antenna and a receiver or transceiver circuit 226 for receiving transmissions from the trainable transceiver 102 and/or an original transmitter 212. Home electronics devices and/or remote devices may also include a control circuit 222 and/or memory 224 for processing the received signal. For example, an activation signal from a trainable transceiver 102 or original transmitter 212 may be received by an antenna and receiver circuit of the transceiver circuit 226. The control circuit 222 may determine whether encryption information transmitted as part of the activation signal matches an expected value. The control circuit 222 may cause an interaction device 230 to activate. For example, the Home electronics devices and/or remote devices may be a garage door opener and the interaction device may be a motor for opening and/or closing the garage door. Upon receipt of the activation signal at the transceiver 226 or receiver circuit, the control circuit 222 may activate the motor after determining that the activation signal included valid encryption information such as a key value.

The home electronics device or remote device 112 may include hardware components for communication with a trainable transceiver 102 or original transmitter 212. In some embodiments, the home electronics device or remote device 112 includes a transceiver circuit 208. The transceiver circuit 208 may be used to send and/or receive wireless transmissions. For example, the transceiver circuit 208 may be or include a transceiver which sends and/or receives radio frequency electromagnetic signals. The transceiver circuit 208 may allow a home electronics device or remote device 112 to receive an activation signal and/or other transmission from a trainable transceiver 102 or original transmitter 212. For example, a trainable transceiver 102 may transmit an activation signal using activation signal parameters acquired as part of a training process. The home electronics device or remote device 112 may receive the activation signal using a transceiver circuit 208. The transceiver circuit 208 may be configured to transmit signals to a trainable transceiver 102, original transmitter 212, and/or other device. For example, the home electronics device or remote device 112 may transmit status information (e.g., that a garage door is closed) or other information. In some embodiments, the trainable transceiver 102 is configured to send and/or receive signals using multiple channels (e.g., a plurality of frequencies of radio waves used for communication). The transceiver circuit 208 of the home electronics device or remote device 112 may function in the same or similar manner as described with reference to the transceiver circuit 208 of the trainable transceiver 102.

The home electronics device or remote device 112 includes memory 224 and/or a control circuit 222 in some embodiments. The memory 224 and/or a control circuit 222 may facilitate and/or carry out the functions of the home electronics device or remote device 112 described herein. The control circuit 222 and/or memory 224 may be the same or similar to the control circuit 202 and/or memory 204 described with respect to the trainable transceiver 102. For example, the control circuit 222 may be or include a processor and the memory 224 may be or include volatile (e.g., flash memory) and/or non-volatile memory (e.g., hard disk storage). The control circuit 222 may carry out computer programs, instructions, and or otherwise use information stored in memory 224 to perform the functions of the home electronics device or remote device 112. For example, the control circuit 222 and memory 224 may be used to process an activation signal (e.g., perform encryption related tasks such as comparing a received key with a stored key, handling instructions included in the signal, executing instructions, processing information, and/or otherwise manipulating or handling a received signal) received by the transceiver circuit 208 and/or control an interaction device in response to the activation signal.

The home electronics device or remote device 112 may further include an interaction device 230. The interaction device 230 may allow the home electronics device or remote device 112 to interact with another device, component, other hardware, the environment, and/or otherwise allow the home electronics device or remote device 112 to affect itself or something else. The interaction device 230 may be an electrical device such as a light, transceiver, or networking hardware. The interaction device 230 may also or alternatively be an electromechanical device such as electric motor, solenoid, or other hardware. The home electronics device or remote device 112 (e.g., a garage door opener) may transmit a signal to a trainable transceiver 102 or original transmitter 212 from which the activation signal originated. The transmission may include information such as receipt of the activation signal, status information about the garage door opener or associated hardware (e.g., the garage door is closed), and/or other information.

Home electronics devices and/or remote devices 112 may include a power source 232 for powering the interaction device 230 and/or other components. For example, the power source 232 may be a connection to a home, office, or other structure's power system (e.g., one or more circuits drawing power from mains power). The power source 232 may be or include other components such as a battery.

In further embodiments, home electronics devices and/or remote devices 112 may include additional components such as sensors 228. Sensors 228 may be or include cameras, light sensors, motion sensors, garage door position sensors, and/or other sensors. Home electronics devices and/or remote devices 112 may use a transceiver circuit 226 to transmit information from or determined based on the sensors 228 to the trainable transceiver 102. The trainable transceiver 102 may display this information using the user interface element 206. Sensors 228 may be used by the device to monitor itself, the environment, hardware controlled by the device, and/or otherwise to provide information to the device. Sensors 228 may provide status information to the device. For example, sensors 228 may be or include, temperature sensors (e.g., thermistor, thermocouple, or other hardware for measuring temperature), movement or acceleration sensors (e.g., accelerometers, inclinometers, or other sensors for measuring orientation, movement, or a derivative thereof), safety beams (e.g., sensors which detect when an infrared, or other spectrum, beam of light is broken by an object), sensor which detect distance (e.g., an ultrasound emitter and receiver configured to determine distance of an object), pressure sensors (e.g., pressure transducer, strain gauge, etc.), or other sensor. In some embodiments, one or more sensors 228 may be configured to determine the status of a garage door opener or garage door. For example, a pressure sensor may be used to determine if a garage door is closed (e.g., in contact with the ground and/or sensor.

Home electronics devices and/or remote devices 112 may be sold with or otherwise be associated with an original transmitter 212. An original transmitter 212 may be a transmitter provided by the manufacturer of the home electronics devices and/or remote devices 112 for wirelessly controlling the home electronics devices and/or remote devices 112. In alternative embodiments, the original transmitter 212 may be a transmitter sold separately from the home electronics device and/or remote device 112 which is configured to control the home electronics device and/or remote device 112. For example, the original transmitter 212 may be a retrofit product, trainable transceiver 102, and/or other transmitter configured to control the home electronics device and/or remote device 112.

The original transmitter may 212 include a transceiver circuit 216, control circuit 214, memory 218, power source 220, and/or other components. The transceiver circuit 216 may be a transceiver or transmitter and may be coupled to and/or include an antenna. The control circuit 214 may control the transceiver to format and transmit an activation signal and/or control signal based on information stored in memory 218 (e.g., device identification information, encryption information, frequency, and/or other information). The control circuit 214 may also handle inputs received from an operator input device such as button included in the original transmitter 212. The original transmitter may have a power source 220 such as a battery.

The original transmitter 212 may include a transceiver circuit 216. As described with reference to the trainable transceiver 102, the transceiver circuit 216 of the original transmitter 212 may allow the original transmitter 212 to send transmissions to an associated device (e.g., home electronics device or remote device 112) and/or receive transmissions from an associated device. For example, an original transmitter 212 may send an activation signal to an associated device and/or may receive status information and or other information from the associated device.

The original transmitter 212 may include a control circuit 214 and/or memory 218. The control circuit 214 and/or memory 218 may facilitate the functions of the original transmitter 212 in the same or similar fashion as described with reference to the trainable transceiver 102. For example, the control circuit 214 may receive a user input from an operator input device (e.g., button). The control circuit 214 may cause the transceiver circuit 216 to transmit an activation signal in response. One or more activation signal parameters may be read by the control circuit 214 from memory 218. For example, the memory 218 of the original transmitter 212 may be non-volatile and store activation signal parameters for an associated device such as a frequency used to receive or send transmissions, frequencies used for the same, channels used for the same, encryption information (e.g., rolling code values, a seed value, etc.), device identification information, modulation scheme, and/or other information.

The transceiver circuit 208 of the trainable transceiver 102 and the transceiver circuit 226 of the home electronics device, remote device 112, original transmitter 212, and/or other device may be configured to communicate send and/or receive wireless signals (e.g., activation signals, communication signals, and/or other signals). This may allow for communication between the trainable transceiver 102 and other device. In one embodiment, the transceiver circuits may be configured to transmit and/or receive radio frequency transmissions. Communication between the trainable transceiver 102 and other device may be unidirectional or bi-directional. In some embodiments, the trainable transceiver 102 and/or other device may be configured to communicate using multiple frequencies. Each frequency may be a channel used for communication. A home electronics device, remote device 112, original transmitter 212, or other device may be configured to communicate using multiple channels for sending and/or receiving radio frequency transmissions using a transceiver circuit 214. For example, a home electronics device (e.g., garage door opener) may be configured to communicate using multiple channels in the 900 MHz band. Continuing the example, a first channel may be 903.925 MHz and a second channel may be 904.075 MHz. In some embodiments, a single channel is used for transmission and/or reception. In other embodiments, a plurality of channels (e.g., two or more channels) may be used for communication by the home electronics device, remote device 112, original transmitter 212, and/or other device.

The trainable transceiver 102 may be trained to use the same plurality of channels or single channel thereby allowing the trainable transceiver 102 to communicate with the device. The trainable transceiver 102 may be trained (e.g., through a training procedure) to send and/or receive radio frequency transmissions using the channel(s) the device is configured to use for transmitting and/or receiving transmissions. The trainable transceiver 102 may store the channel information and/or other information as activation signal parameters for use with the corresponding device. The trainable transceiver 102 may store activation signal parameters (including channel frequencies used by the device) for one or more devices. Using the control circuit, memory, and/or transceiver circuit 214, the trainable transceiver 102 may format activation signals for a plurality of devices. This allows a single trainable transceiver 102 to control a plurality of devices depending on the user input. For example, a trainable transceiver 102 may receive a first user input and format a first activation signal for the device corresponding to a first device associated with the user input. The first activation signal may include or use a first channel or group of channels associated with the first device. This may allow the first device to communicate with the trainable transceiver 102 using a plurality of channels. Continuing the example, a trainable transceiver 102 may receive a second user input and format a second activation signal for the device corresponding to a second device associated with the user input. The second activation signal may include or use a second channel or group of channels associated with the second device. This may allow the second device to communicate with the trainable transceiver 102 using a plurality of channels.

A trainable transceiver 102 may be trained to an existing original transmitter 212 such that the trainable transceiver 102 controls the device associated with the original transmitter 212. For example, a user may place the trainable transceiver 102 and original transmitter 212 such that the trainable transceiver 102 is within the transmission range of the original transmitter 212. The user may then cause the original transmitter 212 to send an activation signal or other transmission (e.g., by depressing a button on the original transmitter 212). The trainable transceiver 102 may identify one or more activation signal parameters, the device, and/or other information based on the transmission from the original transmitter 212 which the trainable transceiver 102 may receive using the transceiver circuit 214. The control circuit, memory, and/or other transceiver circuit 214 may identify, determine, and or store information such as the frequency, frequencies, or channels used by the original transmitter 212 and therefore the device associated with the original transmitter 212, a control code or other encryption information, carrier frequency, bandwidth, and or other information.

In some embodiments, the home electronics device, remote device 112, or other device may be configured to learn an identifier, encryption information, and/or other information from a trainable transceiver 102. For example, the device may be placed in a learning mode during which time a user sends a transmission from the trainable transceiver 102 (e.g., by providing an input causing the transmission). The device may receive the transmission and perform a function in response. For example, the device may send an acknowledgement transmission in response to receiving the transmission, send a transmission including a ready indication (e.g., that the device is synchronized with the trainable transceiver 102, encryption information has been exchanged, communication has been acknowledged on all channels used by the device, etc.), store an identifier of the trainable transceiver 102, and/or perform other functions. This process may constitute a pairing of the trainable transceiver 102 and the home electronics device, remote device 112, or other device. For systems using a rolling code, the trainable transceiver 102 and device may be synchronized so that the counters of the trainable transceiver 102 and the device begin with the same rolling code value.

Figure 3:
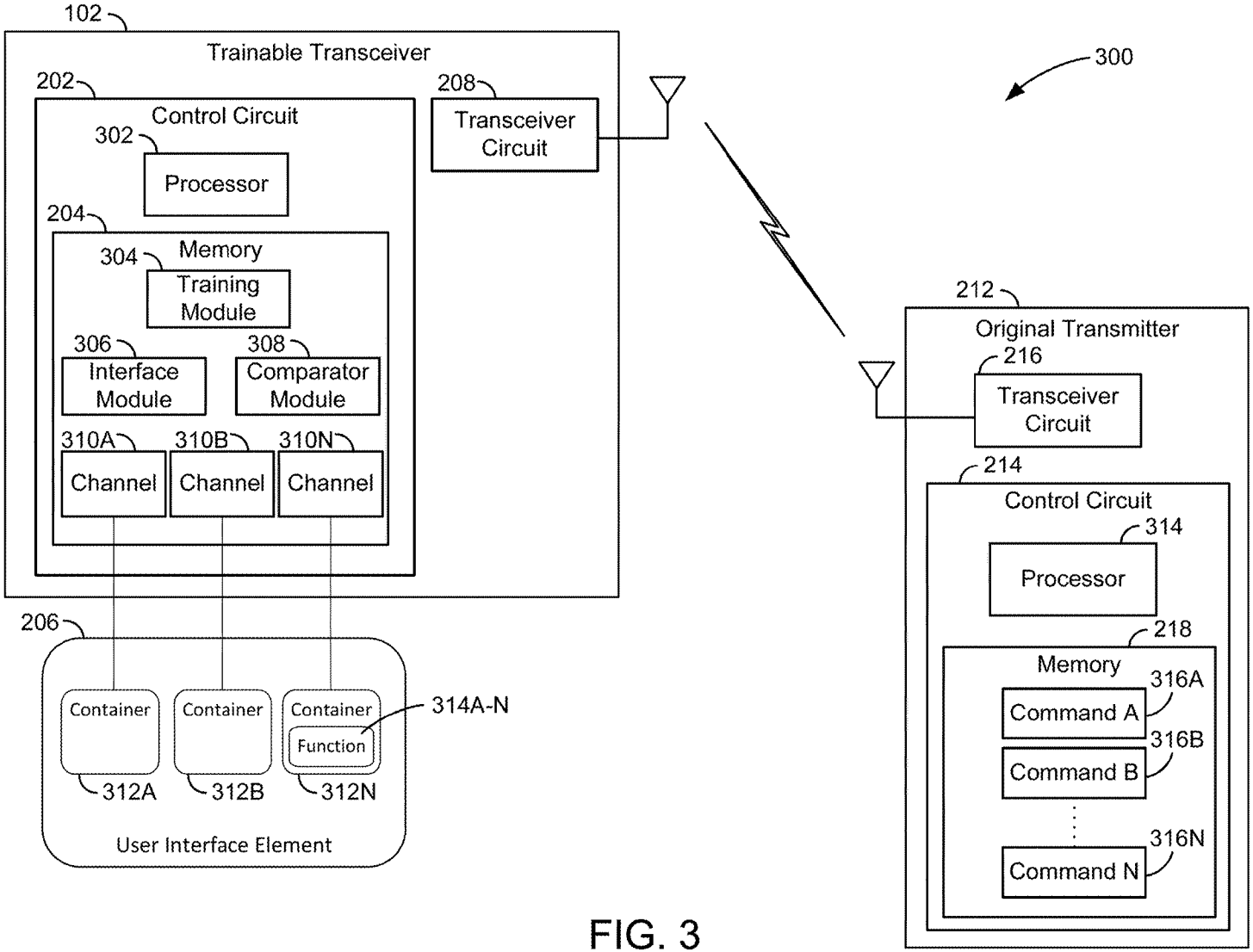
FIG. 3 is a block diagram of a trainable transceiver and the external devices with which the trainable transceiver can communicate, according to another illustrative embodiment.

Referring now to FIG. 3, a block diagram of the trainable transceiver 102 in communication with the original transmitter 212 is shown, in accordance with an illustrative embodiment. The trainable transceiver 102 and original transmitter 212 may include the components and features illustrated and described above with reference to FIG. 2. In addition, the control circuit 202 of the trainable transceiver 102 may include a processor 302. The memory 204 of the control circuit 202 may include a training module 304, comparer module 306, and one or more channels 310A-310N. The user interface element 206 may include or may display one or more container elements 312A-312N. Each of the container elements 312A-312N may include one or more soft keys 314A-314N and may be associated with a function stored in the corresponding channel 310A-310N. In some embodiments, the container elements 312A-312N may themselves be a soft key or a command button (e.g., in the case of one soft key 314A-314N at the container element 312A-312N). The control circuit 214 of the original transmitter 212 may include a processor 314. The memory 218 of the original transmitter 212 may include one or more commands 316A-316N. Each of the commands 316A-316N may correspond to controlling a corresponding function the remote device 112 (e.g., unlock, lock, etc.), and may be associated with a different control signal.

The control circuit 202 of the trainable transceiver 102 may include one or more modules in 204 for carrying out and/or facilitating the operation of the trainable transceiver 102 described herein. For example, the control circuit 202 may include a training module 304, interface module 306, and comparator module 308 in memory 204. The modules of the control circuit 202 may be executed or otherwise handled or implemented using a processor 302. The processor 302 may be a general or application specific processor or circuit for performing calculations, handling inputs, generating outputs, and/or otherwise performing computational tasks. In some embodiments, the modules (e.g., training module 304, interface module 306, and comparator module 308) may each be a general or application specific processor or circuit for performing the instructions specified therein.

The user interface element 206 may include an electronic display. The electronic display of the user interface element 206 may be a touch-sensitive and reconfigurable. The electronic display may include hardware or a combination of software and hardware to determine a coordinate of a screen press. The user interface element 206 may be configured to display the one or more container elements 312A-312N. Each of the one or more container elements 312A-312N may include one or more soft keys. In some embodiments, each of the one or more container elements 312A-312N may include one or more functions 314A-314N. Each of the one or more functions 312A-312N may correspond to a soft key of the container element 312A-312N. Responsive to detecting a screen press on the electronic display, the user interface element 206 or the processor 302 of the control circuit 202 may determine which function 314A-314N or container element 312A-312N the screen press corresponds to. Upon determining which function 314A-314N or container element 312A-312N the screen press corresponds to, the control circuit 202 may identify the respective channel 310A-310N transmit and may transmit the corresponding control signal. In some embodiments, the user interface element 206 may be situated with the other components and/or modules of the trainable transceiver 102. In some embodiments, the user interface element 206 may be situated away from the other components and/or modules of the trainable transceiver 102 (e.g., at the center stack 106). Additional details of the contents of the electronic display of the user interface element 206 are detailed herein in conjunction with FIG. 4A-4G.

The training module 304 may include instructions, programs, executable code, and/or other information used by the control circuit 202 to perform training functions. The training module 304 may learn control information from the original transmitter 212 to control the remote device 112. The training module 304 may analyze the received signal using one or more algorithms, look up tables, and/or other information structures/techniques. The training module 304 may also store one or more characteristics of the signal received from the original transmitter 212 in memory 204. Using the signal received from the original transmitter 212, the training module 304 may also train each of the one or more channels 310A-310N to control a function of the remote device 112. The training module 304 may also initially store the one or more characteristics of the received signal to one of the one or more channels 310A-310N.

The interface module 306 may include instructions, programs, executable code, and/or other information used by the control circuit 202 to assign the one or more channels 310A-310N to a corresponding container element 312A-312N on the user interface element 206. A single channel 310A-310N may correspond to instructions, programs, executable code, and/or other information used by the control circuit 202 to transmit a corresponding control signal to the remote device 112 via the transceiver circuit 208. The corresponding control signal may control one or more functions of the remote device 112. Receipt of the corresponding control signal by the remote device 112 may cause the remote device 112 to perform the respective function.

The comparator module 308 may include instructions, programs, executable code, and/or other information used by the control circuit 202 to compare signals (or control information) stored by the training module 304 in memory 204. The comparator module 308 may access the memory 204 to retrieve the signals stored by the training module 304. In some embodiments, the comparator module 308 may receive the signals from the original transmitter 212 via the transceiver circuit 208. The comparator module 308 may detect or determine whether any two signals received from the original transmitter 212 are similar or dissimilar based on any number of factors.

The training module 304, the interface module 306, and the comparator module 308 may operate in conjunction to allow the trainable transceiver 102 to selectively transmit control signals to control one of the functions at the remote device 112. The training module 304 may use the control signal from the original transmitter 212 to train the trainable transceiver 102. The original transmitter 212 may transmit a control signal for controlling one or more of the functions at the remote device 112. The control signal may correspond to one of the commands 316A-316N stored in memory 218. The command 316A-316N may correspond to a function at the remote device 112. In some embodiments, the control signal may include one or more messages (e.g., binary codes) based on time duration of a button press. Each message of the control signal may control a different function at the remote device 112. For example, the control signal may have three binary codes in repeated sequence in time depending on the time duration of the button press. A first binary code may be for the first 250 milliseconds (ms) and may correspond to a lock function at the remote device 112; a second binary code may be for the next 250 ms and may correspond to an enrolling or pairing function to pair with the remote device 112; and a third binary code may be for the next 250 ms and may correspond to an unlock function at the remote device 112. In some embodiments, the control signal may include a single message for controlling a single function at the remote device 112. For example, the original transmitter 212 may send: an unlock function at the remote device 112, if an unlock button is pressed; a lock function at the remote device 112, if a lock button is pressed; and an enroll function with the remote device 112, if both the unlock and lock buttons are pressed simultaneously.

The training module 304 may receive the message or the control signal from the original transmitter 212. Using the message from the original transmitter 212, the training module 304 may train one of the channels 310A-N to the corresponding function of the remote device 212. In some embodiments, the training module 304 may learn the control information from the message (or the associated signal) from the original transmitter 212 using any number of techniques. The training module 304 may analyze or parse the control signals from the original transmitter 212. Based on the analysis or parsing of the message, the training module 304 may store the control information in memory 204 in one of the channels 310A-310N. The one or more channels 310A-310N may be used by the control circuit 202 of the trainable transceiver 102 to control the corresponding function at the remote device 112. The training module 304 may repeat this functionality over multiple messages and/or signals.

The comparator module 308 may determine or detect whether a first message from the original transmitter 212 is similar to a second message from the original transmitter 212. In some embodiments, first message and/or the second message (or the control information thereof) may be initially stored in different channels 310A-310N. In some embodiments, the first message (or the control information thereof) may have learned prior to learning of the second message. The comparator module 308 may identify or otherwise determine which channel 310A-N is set to transmit one of the messages for a corresponding function of the remote device 112. The comparator module 304 may determine or detect whether a first message characteristic of the first message is similar to a second message characteristic of the second message. Examples of message characteristics may include a time duration, a binary code, an encryption information (e.g., a rolling code, rolling code seed, look ahead codes, secret key, fixed code, or other information related to an encryption technique), among others. The comparator module 304 may identify the first message characteristic from the first message and the second message characteristic from the second message. The comparator module 304 may compare the first message characteristic of the first message to the second message characteristic of the second message.

In some embodiments, the comparator module 308 may analyze the control signal to identify a first time length of the first message and a second time length of the second message. The comparator module 308 may maintain a timer to determine or identify the first time length and the second time length. The comparator module 308 may compare the first time length to the second time length. In some embodiments, the comparator module 308 may determine whether the first time length differs from the second time length by a predefined time margin. If the first time length differs from the second time length by less than the predefined margin, the comparator module 308 may compare other message characteristics of the first message to the other message characteristics of the second message (e.g., differences in binary code). If the first time length differs from the second time length by greater than or equal to the predefined margin, the comparator module 308 may determine that the first message characteristic of the first message is dissimilar to the second message characteristic of the second message.

In some embodiments, the comparator module 308 may analyze the control signal to identify a type of encryption of the first message and a type of encryption of the second message. The comparator module 308 may identify the type of encryption for the first message and the type of encryption for the second message based on multiple samples of the control signal. For example, if the control signal has been encoded using fixed code, the first message and the second message at the second sample may be a repeat of the first message and of the second message at the first sample. In this case, the comparator module 308 may identify that the first message and the second message at the second sample is a repeat of the first message and of the second message at the first sample. The comparator module 308 may determine that the first message and the second message are not encrypted and are fixed code as opposed to rolling code. The comparator module 308 may compare the type of encryption for the first message to the type of encryption for the second message. If the type of encryption for the first message is the same as the type of encryption for the second message, the comparator module 308 may compare other message characteristics of the first message to the other message characteristics of the second message (e.g., differences in binary code). If the type of encryption for the first message differs from the type of encryption for the second message, the comparator module 308 may determine that the first message characteristic of the first message is dissimilar to the second message characteristic of the second message.

In some embodiments, the comparator module 308 may parse the message to identify a corresponding binary code. The binary code may be of any bit length (e.g., 16-bit, 32-bit, 64-bit, 128-bit, 256-bit, etc.). The binary code may include one or more fields (e.g., bit or bits for serial number, status information, encrypted portion, unencrypted portion, function code, error detection, etc.). The comparator 308 may determine a bitwise difference between a first binary code of the first message and a second binary code of the second message. The bitwise difference may include bit length and number of different bits between the first binary code and the second binary code. The comparator module 308 may identify one or more fields from the binary code and a type of field for the one or more fields. The comparator module 308 may limit the determination of the different to a subset of the one or more fields. For example, the comparator module 308 may determine that both the first binary code and second binary code as 128-bit long messages and may identify the function code field in each of the first binary code and the second binary code. In this scenario, the function code field may be 4-bits long and may indicate whether the remote device 112 is to unlock or lock a garage door. In some embodiments, the comparator module 308 may compare the bitwise difference between the first binary code and the second binary code to a bitwise threshold. For example, to calculate the bitwise difference the comparator module 308 may use an exclusive-or operation to generate a resultant of equal length as the first binary code and the second binary code. The comparator module 308 may then identify a number of Is in the resultant and compare to a threshold number. If the bitwise difference is greater than or equal to the bitwise threshold, the comparator module 308 may determine that the first binary code of the first message is dissimilar to the second binary code of the second code. If the bitwise difference is less than the bitwise threshold, the comparator module 308 may determine that the first binary code of the first message is similar to the second binary code of the second code.

In some embodiments, the comparator module 308 may parse the control signal to determine whether two or more messages are interleaved in the control signal. To determine whether two or more messages are interleaved in the control signal, the comparator module 308 may determine whether the first message is temporally subsequent to (or followed by) the second message (and vice-versa) in the control signal. For example, in the control signal, the first binary code may be for the first 5 seconds and may correspond to a command function at the remote device 112 and the second binary code may be for the immediate next 50 seconds and may correspond to a pairing function with the remote device 112. If the first message is temporally subsequent to the second message (and vice-versa), the comparator module 308 may determine that the first message is similar to the second message. If the first message is not temporally subsequent to the second message (or vice-versa), the comparator module 308 may determine that the first message is dissimilar to the second message. In some embodiments, the comparator module 308 may identify a number of messages interleaved in the control signal.

If the comparator module 308 determines that the first message is similar to the second message, the interface module 306 may set or otherwise combine the first function corresponding to the first message and the second function to the second message to the same channel 310A-310N. In this manner, the container element 312A-312N corresponding to the channel 310A-310N may be pressed to control either the first function or the second function at the remote device 112, thereby freeing up the other channels 310A-310N and container elements 312A-312N for other functions. In some embodiments, the interface module 306 may transfer the control information for the respective function from one channel 310A-310N to another channel 310A-N in memory 204. In some embodiments, the interface module 306 may reconfigure the user interface element 206, responsive to the setting of the first function and the second function to the same channel 310A-310N. In some embodiments, the interface module 306 may cause rendering of container elements 312A-312N or one or more soft keys 314A-314N in the container elements 312A-312N on the user interface element 208. An interaction (e.g., screen press) with any of the container elements 312A-312N or the soft keys 314A-314N therein may cause the control circuit 202 to transmit a control signal for the respective function to control the remote device 112. In some embodiments, the interface module 306 may set or otherwise combine the first function corresponding to the first message and the second function corresponding to the second message to the same channel 310A-N regardless of whether the first message is similar to the second message.

Prior to setting the first function and the second function (or any number of functions) to the same channel 310A-310N, the interface module 306 may also cause the user interface element 208 to display a prompt for selecting the first function and/or the second function to the same container element 312A-312N. The prompt for selecting may include a first soft key for an affirmative response. The prompt may also include a second soft key for a negative response. The prompt may indicate to the operator of the trainable transceiver 102 whether to assign the first channel and/or the second channel to the same channel 310A-310N. The prompt may indicate to the operator of the trainable transceiver 102 whether to assign the first channel and/or the second channel to the same container element 312A-312N. If the first soft key is pressed indicating an affirmative response, the interface module 306 may set the first function and the second function to the same channel 310A-310N, and may display, on the respective container element 312A-312N, a first soft key 314A-314N for the first function and a second soft key 314A-314N for the second function. If the second soft key is pressed indicating a negative response, the interface module 306 may set the first function and the second function to different channels 310A-310N and different container elements 312A-312N. In either conditional, the interface module 306 may cause the user interface element 208 to display a prompt for naming the soft key 314A-314N or container element 312A-312N corresponding to the first function and the soft key 314A-314N or container element 312A-312N corresponding to the second function. The prompt for naming may include a touch-sensitive keyboard (e.g., a QWERTY keyboard, a Dvorak keyboard, etc.) for receiving alphanumeric input.

Instead of setting both the first function and the second function to the same channel 310A-310N, the interface module 306 may also cause the user interface element 208 to display a prompt for deleting (or overwriting) the first function or the second function from the channel 310A-310N. The prompt for deletion may include a first soft key corresponding to deletion of the first function and the second soft key corresponding to deletion of the second function. If the first soft key is pressed, the interface module 306 may overwrite the first function from the channel 310A-310N and set the second function to the channel 310A-310N. If the second soft key is pressed, the interface module 306 may delete and/or overwrite the second function from the channel 310A-310N, and set the first function to the channel 310A-310N.

Upon the addition of functions to the channel 310A-310N, the interface module 306 may also cause the user interface element 208 to display a prompt for deleting functions from the channel 310A-310N. The interface module 306 may identify a number of functions trained to the channel 310A-310N. The interface module 306 may compare the number of trained functions to a maximum number. The maximum number may be based on memory constraints or display size limitations (e.g., size of the soft keys 314A-314N and the container elements 312A-312N to the size of the user interface element 206). If the interface module 306 determines that the number of trained functions is greater than the maximum number, the interface module 306 may cause the user interface element 208 to display a prompt for deleting any one of the functions from the channel 310A-310N. The prompt for deletion may include any number of soft keys equal to a number of functions for the channel 310A-310N. The soft keys may correspond to one of the functions set or assigned to the channel 310A-310N. In response to pressing of any one of the soft keys 314A-314N, the interface module 306 may delete or overwrite the corresponding function from the channel 310A-310N. The interface module 306 may then remove the corresponding soft key 314A-314N from display on the user interface element 208.

In some embodiments, if the comparator module 308 identifies the number of similar messages in the control signal from the original transmitter 212 corresponding to functions, the interface module 306 may set an equal number of soft keys 314A-314N for the respective container element 312A-312N. In some embodiments, the container element 312A-312N may initially include more soft keys 314A-314N than the number of functions stored in the respective channel 310A-310N. The interface module 306 may identify the number of soft keys 314A-314N in each container element 312A-314N. The interface module 306 may identify the number of functions in the channel 310A-310N associated with the corresponding container element 312A-312N. The interface module 306 may compare the number of soft keys 314A-314N to the number of functions in the channel 310A-310N and may determine a difference between the number of soft keys 314A-314N and the number of functions stored in the channel 310A-310N. If the interface module 306 determines that the number of soft keys 314A-314N is greater than the number of functions stored in the channel 310A-310N, the interface module 306 may remove a subset of the soft keys 314A-314N equal to the difference from the respective container element 312A-312N. If the interface module 306 determines that the number of soft keys 314A-314N is less than the number of functions stored in the channel 310A-310N, the interface module 306 may add more soft keys 314A-314N equal to the difference to the respective container element 312A-312N.

On the other hand, if the comparator module 308 determines that the first message is dissimilar from the second message, the interface module 306 may set the first function corresponding to the first message and the second function to the second message to the different channels 310A-310N, such as a first channel 310A and a second channel 310B. In some embodiments, the interface module 306 may transfer the control information for the respective function from one channel 310A-310N to another channel 310A-N in memory 204. In some embodiments, the interface module 306 may delete or overwrite the control information for the first function from one channel 310A-310N with other control information corresponding to the second function in memory 204. In some embodiments, the interface module 306 may reconfigure the user interface element 206, responsive to the setting of the first function and the second function to the different channels 310A-310N or the deletion or overwriting of one of the first function and the second function.

To set the first function and the second function to different channels 310A-310N, the interface module 306 may also cause the user interface element 208 to display a prompt for selecting different channels 310A-310N for the first function and for the second function. The prompt for selection may include any number of soft keys. Each of the soft keys may correspond to one of the container elements 312A-312N associated with the respective channel 310A-310N. The soft keys may appear above, below, or adjacent to an area of the corresponding container element 312A-312N on the user interface element 208. Upon the pressing of one of the soft keys, the interface module 308 may set the first function to one container element 312A-N and the corresponding channel 310A-N and then may set the second function to another container element 312A-312N and the corresponding channel 310A-310N.

In some embodiments, to set the first function and the second function to the same channel 310A-310N despite the determination that the first message is dissimilar from the second message, the interface module 306 may also cause the user interface element 208 to display a prompt for selecting any of channels 310A-310N for the first function and for the second function. The prompt for selection may include any number of soft keys. Each of the soft keys may correspond to one of the container elements 312A-312N associated with the respective channel 310A-310N. The soft keys may appear above, below, or adjacent to an area of the corresponding container. Upon the pressing of one of the soft keys, the interface module 308 may set both the first function and the second function to the corresponding container element 312A-N and the corresponding channel 310A-N. In some embodiments, responsive to setting both the first function and the second function to the corresponding container element 312A-N and the corresponding channel 310A-N, the interface module 306 may cause the user interface element 208 to display a prompt requesting confirmation of the assignment. In response to an affirmative response to the prompt, the interface module 306 can set both the first function and the second function to the corresponding container element 312A-N and the corresponding channel 310A-N. In response to a negative to the prompt, the interface module 306 can cause the user interface element 208 to again display a prompt for selecting any of the channels 310A-N for the first function and the second function.

Instead of having both the first function and second function, the interface module 306 may also cause the user interface element 208 to display a prompt for deleting (or overwriting) the first function or the second function from the channel 310A-310N. The prompt for deletion may include a first soft key corresponding to deletion of the first function and the second soft key corresponding to deletion of the second function. The first soft key and the second soft key may appear above, below, or adjacent to the respective soft key 314-314N of the container element 312A-312N on the user inter face element. If the first soft key is pressed, the interface module 306 may overwrite the first function from the channel 310A-310N. The interface module 308 may then set the second function to the channel 310A-310N. If the second soft key is pressed, the interface module 306 may delete and/or overwrite the second function from the channel 310A-310N. The interface module 308 may then set the first function to the channel 310A-310N.

Referring now to FIGS. 4A-4G, various configurations 400A-400G of the user interface element 206 are shown, according to illustrative embodiments. In the context of the various components and modules detailed herein in reference to FIGS. 2 and 3, the interface module 306 (or the control circuit 212) may cause the user interface element 206 to render and/or display on an electronic display one of the various configurations 400A-400G, among others. In brief overview, each of the configurations 400A-400G may be rendered and/or displayed on the electronic display connected to the trainable transceiver 102.

Figure 4A:
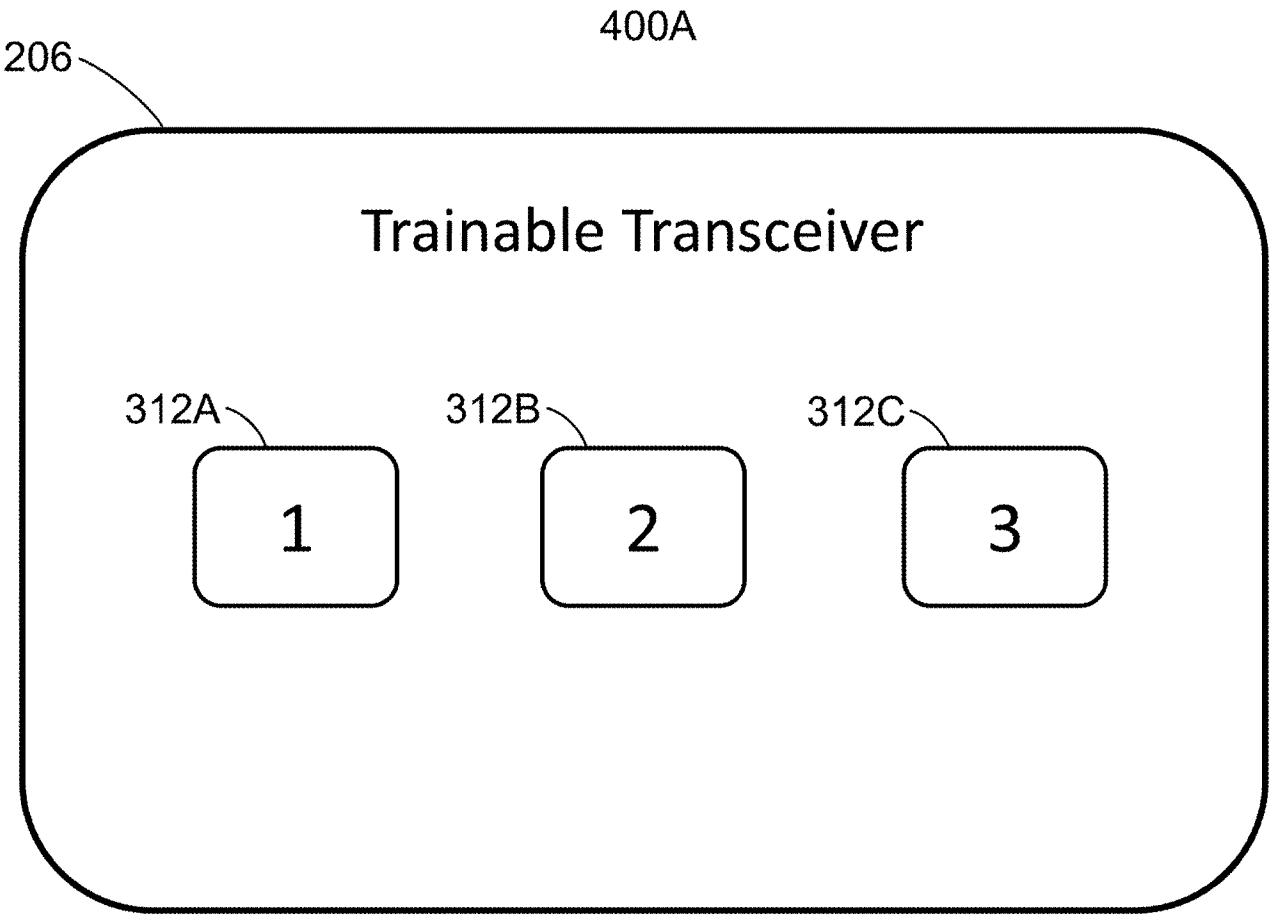
FIGS. 4A-4G are block diagrams of various configurations for a user interface element of a trainable transceiver, according to illustrative embodiments.

Starting with FIG. 4A, the user interface element 206 may display configuration 400A as depicted. Configuration 400A may represent a starting menu with each container element 312A-312C. Each of the three container elements 312A-312C may be soft keys and may perform one function. Furthermore, each of the three container elements 312A-312C may be associated with a corresponding channel 310A-310N. In some embodiments, the training module 304 may not have yet trained to control any function at the remote device 112, using control signal(s) from the original transmitter 212. At this stage, pressing of any of the container elements 312A-312C may trigger a default action or a null action.

Figure 4B:
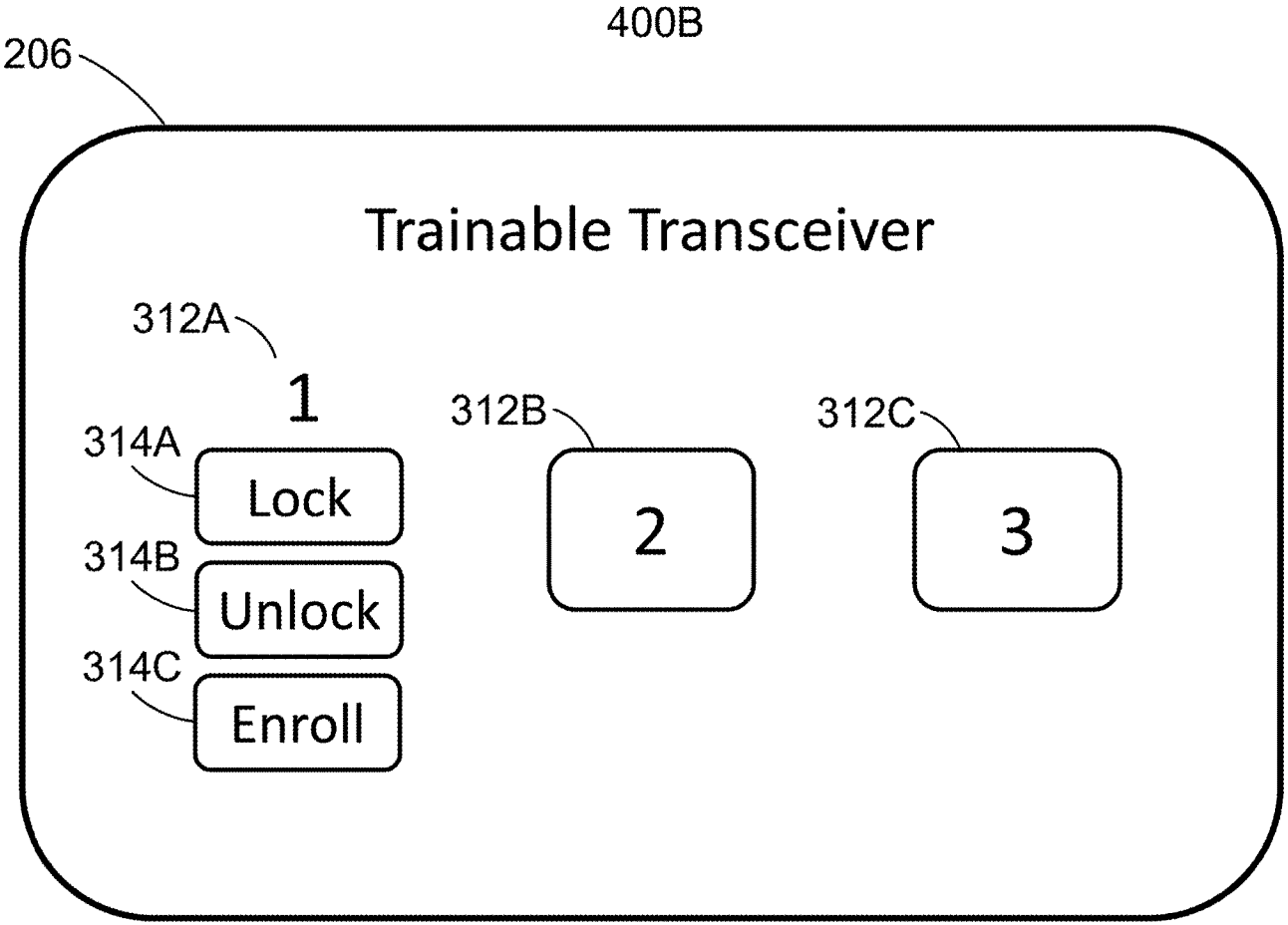

Moving onto FIG. 4B, the user interface element 206 may display configuration 400B as shown. In configuration 400B, the container element 312A may include three soft keys 314A-314C. In context, the training module 304 may have trained using the control signal(s) for the three commands 316A-316C from the original transmitter 212, and may have stored the control information for the three commands 316A-316C in memory 204. The three commands 316A-316C may be: a lock function to lock a garage door connected to the remote device 112, an unlock function to unlock the garage door connected to the remote device 112, and an enroll function to pair a remote control (e.g., original transmitter 212 or the trainable transceiver 102) with the remote device 112. In turn, the comparator module 308 may have determined that the message characteristics for the three functions may be similar to one another, and may have stored the control information in the first channel 310A. In response, the interface module 306 may cause the user interface element 206 to display configuration 400B with the three soft keys 314A-314C in the first container element 312A-C. With configuration 400B, pressing of the first soft key 314A may trigger the trainable transceiver 102 to transmit a first message to the remote device 112 to actuate the lock function. Pressing of the second soft key 314B may trigger the trainable transceiver 102 to transmit a second message to the remote device 112 to actuate the unlock function. Pressing of the third soft key 314C may trigger the trainable transceiver 102 to transmit a third message to the remote device 112 to enroll or pair the trainable transceiver 102 with the remote device 112 to allow for future commands to be actuated at the remote device 112.

Figure 4C:
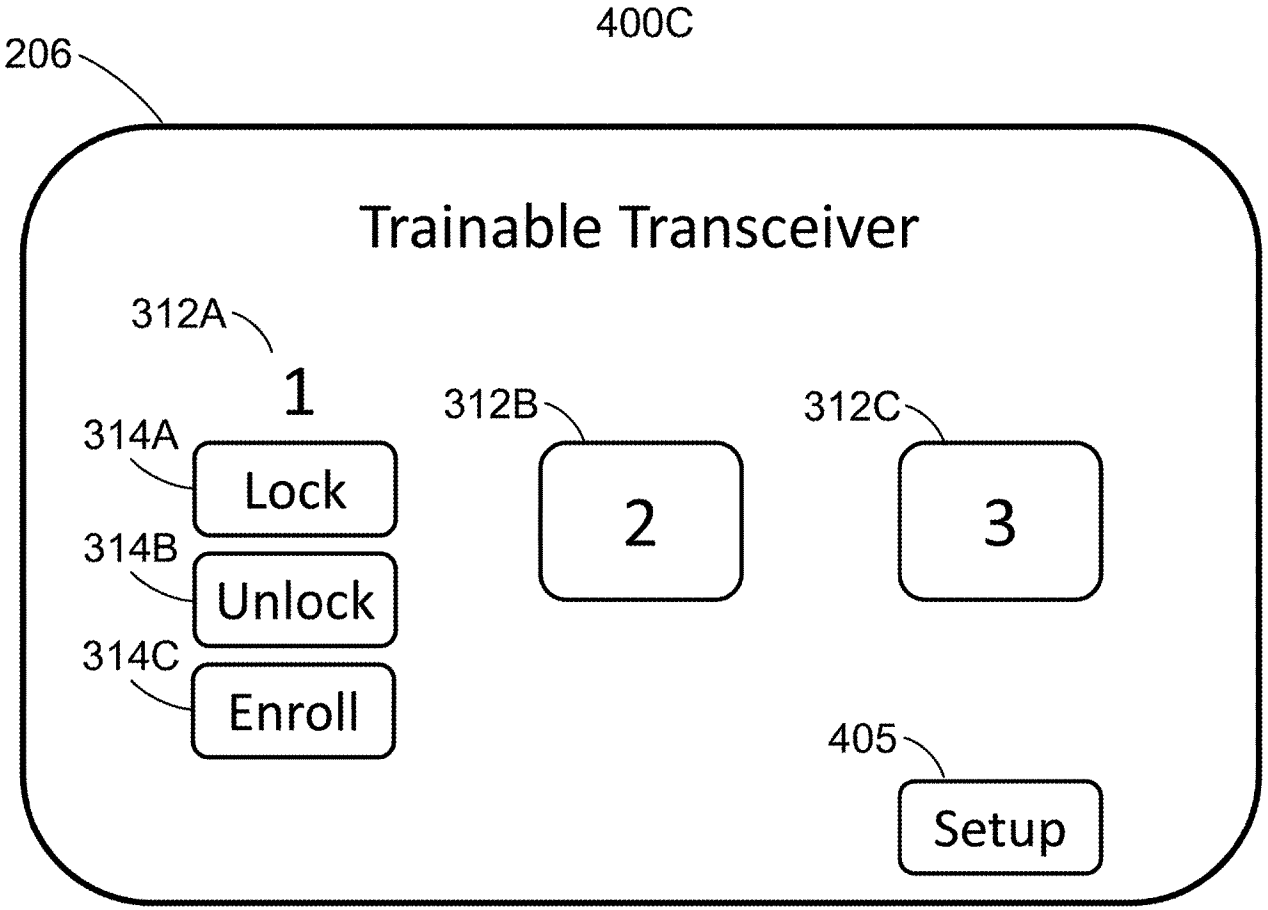

In FIG. 4C, the user interface element 206 may display configuration 400C. Configuration 400C may be a prompt for modifications to any of the container elements 312A-312C or the soft keys 314A-314C therein. In comparison to configuration 400B, configuration 400C may additionally include a setup button 405. The setup button 405 may be another soft key similar to the other soft keys 314A-314C. The setup button 405 may be used by the interface module 306 to modify the user interface element 206. Pressing of the setup button 405 may cause the user interface element 206 to display a prompt for more specific modifications (e.g., editing of soft keys 314A-314C, deletion of soft keys 314A-314C, addition of functions, training to control another remote device, etc.) to the user interface element 206. Examples of prompts for modifications to the user interface element 206 are described herein in reference to FIGS. 4D and 4E.

Figure 4D:
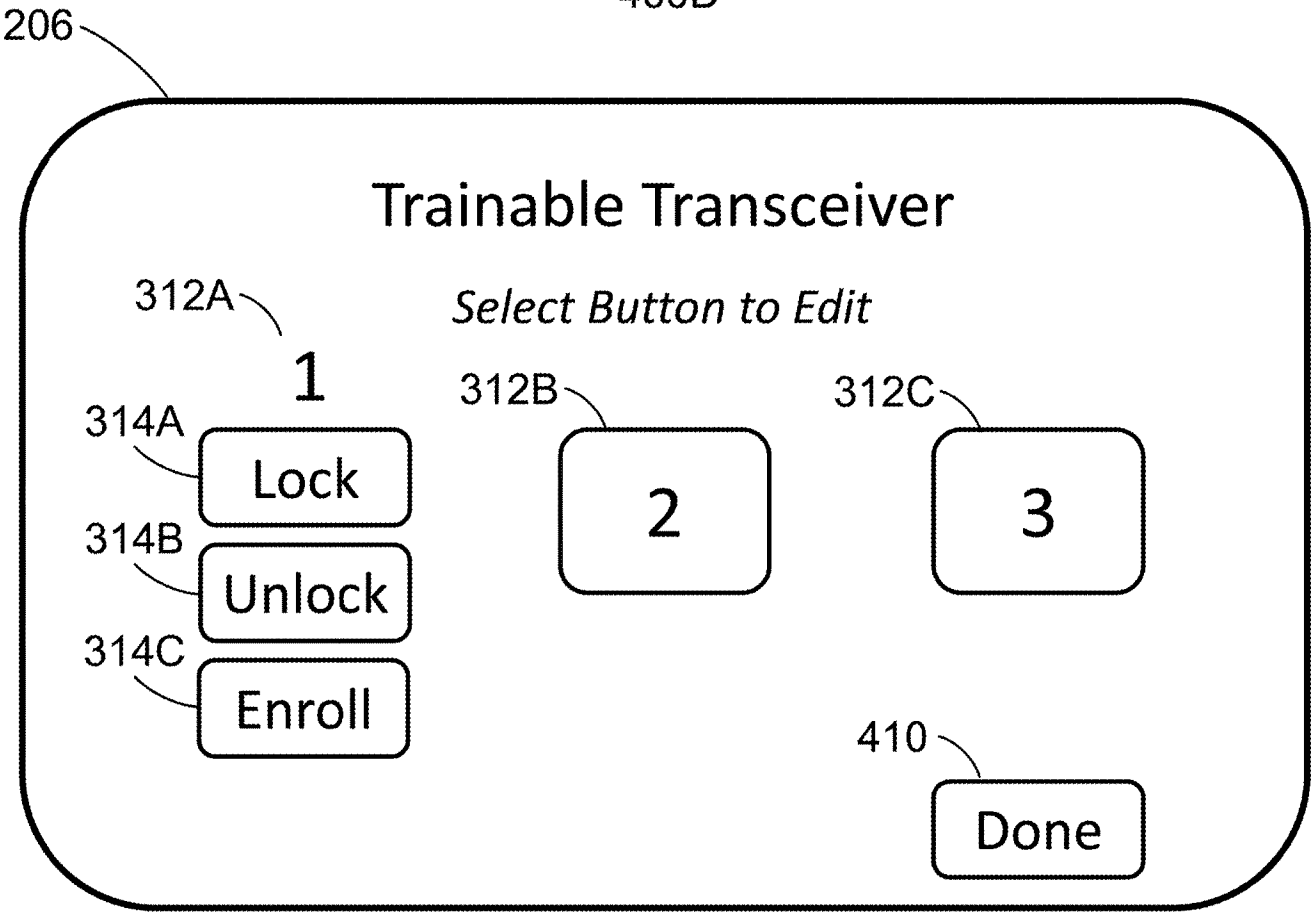

In FIG. 4D, the user interface element 206 may display configuration 400D. Configuration 400D may be a prompt for editing (e.g., renaming, reposition, or resize, etc.) of soft keys 314A-314C or container elements 312A-312C. In relation to configuration 400C, the user interface element 206 may display configuration 400D, responsive to the pressing of the setup button 405. Configuration 400D may include text, such as "Select Button to Edit," to indicate to the operator of the trainable transceiver 102 which type of modification is selected. Configuration 400D may additionally include a done button 410. In configuration 400D, pressing of any of the soft keys 314A-314C or the container elements 312A-312C may allow the operator to edit the respective soft key 314A-314C or the container element 312A-312C (e.g., rename, reposition, or resize, etc.). Pressing of the done button 410 may save and set the edits to the respective soft key 314A-314C or the container element 312A-312C.

Figure 4E:
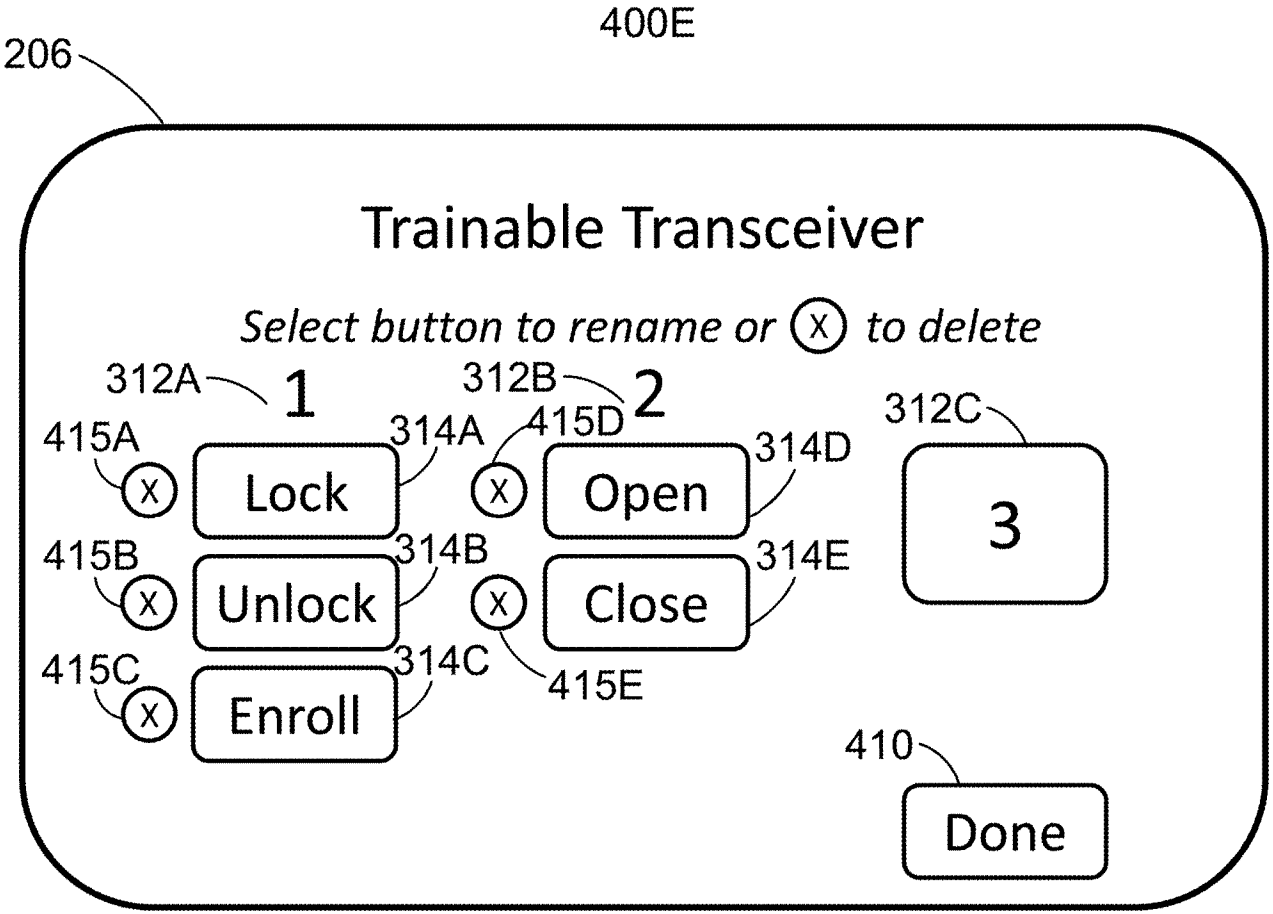

In FIG. 4E, the user interface element 206 may display configuration 400E. Configuration 400E may be a prompt for editing or deleting of any of the soft keys 314A-314E. The fourth soft key 314D and the fifth soft key 314E of the second container element 312B may have been generated using similar techniques in reference to the first soft key 314A, second soft key 314B, and third soft key 314C of the first container element 312A. In relation to configuration 400C, the user interface element 206 may display configuration 400E, responsive to the pressing of the setup button 405. Configuration 400E may also include text, such as "Select button to rename or (X) to delete," to indicate to the operator of the trainable transceiver 102 which types of modifications are available. Configuration 400E may include a done button 410 for saving the editions or deletions. Configuration 400E may also include one or more radio buttons 415A-415E for removing the corresponding soft key 314A-314E. The one or more radio buttons 415A-415E may be generally placed adjacent to the corresponding soft key 314A-314E. Pressing of the one or more radio button 415A-415E may remove the corresponding, adjacent soft key 314A-314E. Pressing of any of the soft keys 314A-314E or the container elements 312A-312C may allow the operator to edit the respective soft key 314A-314E or the container element 312A-312C (e.g., to rename, reposition, or resize, etc.). Pressing of the done button 410 may save and set the editions to and/or deletion the respective soft key 314A-314E or the container element 312A-312C.

Figure 4F:
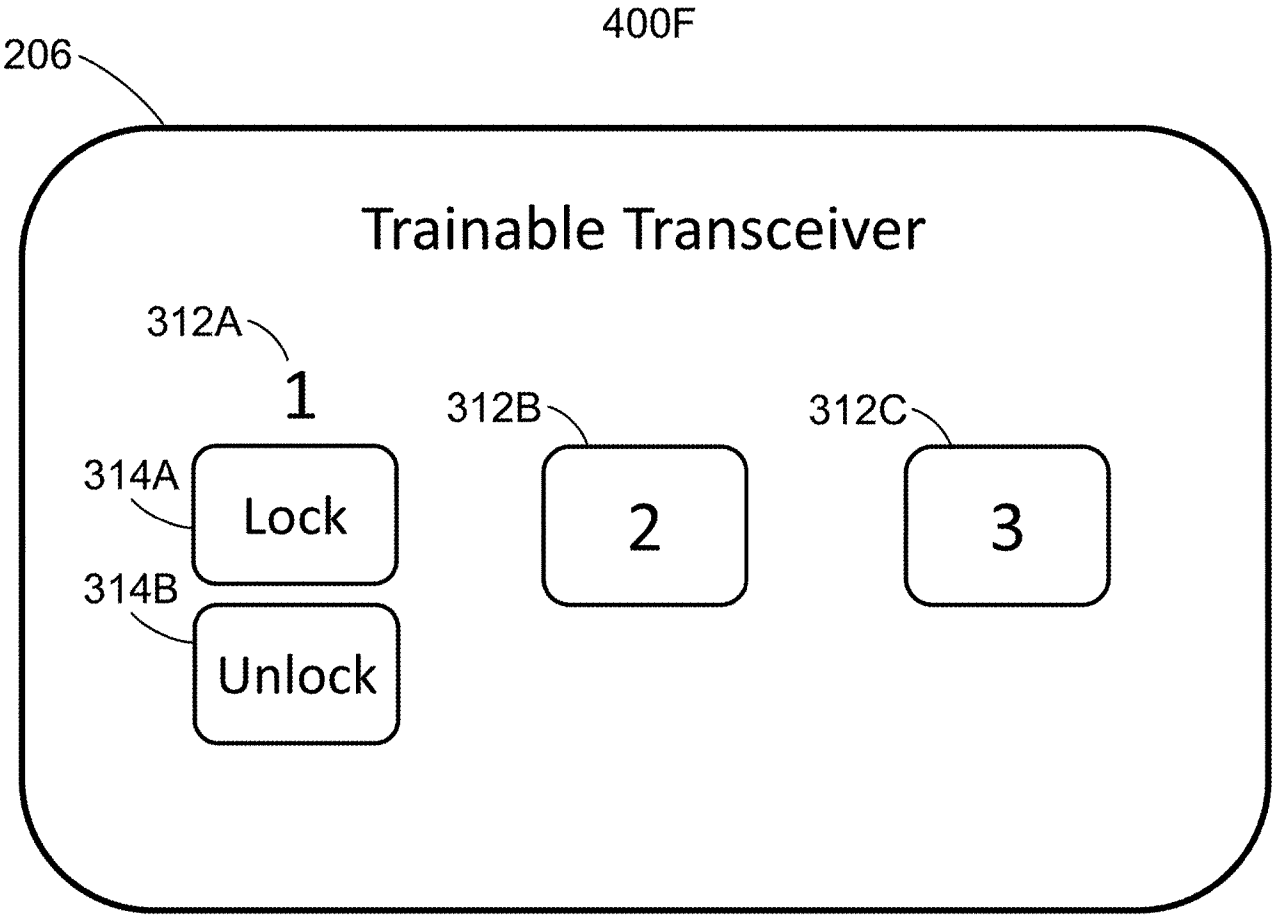

In FIG. 4F, the user interface element 206 may display configuration 400F. In relation to configuration 400E, configuration 400F may be the resultant configuration after the edition or deletion of soft keys 314A-314E from the user interface element 206. In the example depicted, the operator may have caused the deletion of the third soft key 314C ("enroll"), fourth soft key 314D ("open"), and the fifth soft key 314E ("close"). In configuration 400F, pressing of the first soft key 314A may trigger the trainable transceiver 102 to transmit a first message to the remote device 112 to actuate the lock function. Pressing of the second soft key 314B may trigger the trainable transceiver 102 to transmit a second message to the remote device 112 to actuate the unlock function.

Figure 4G:
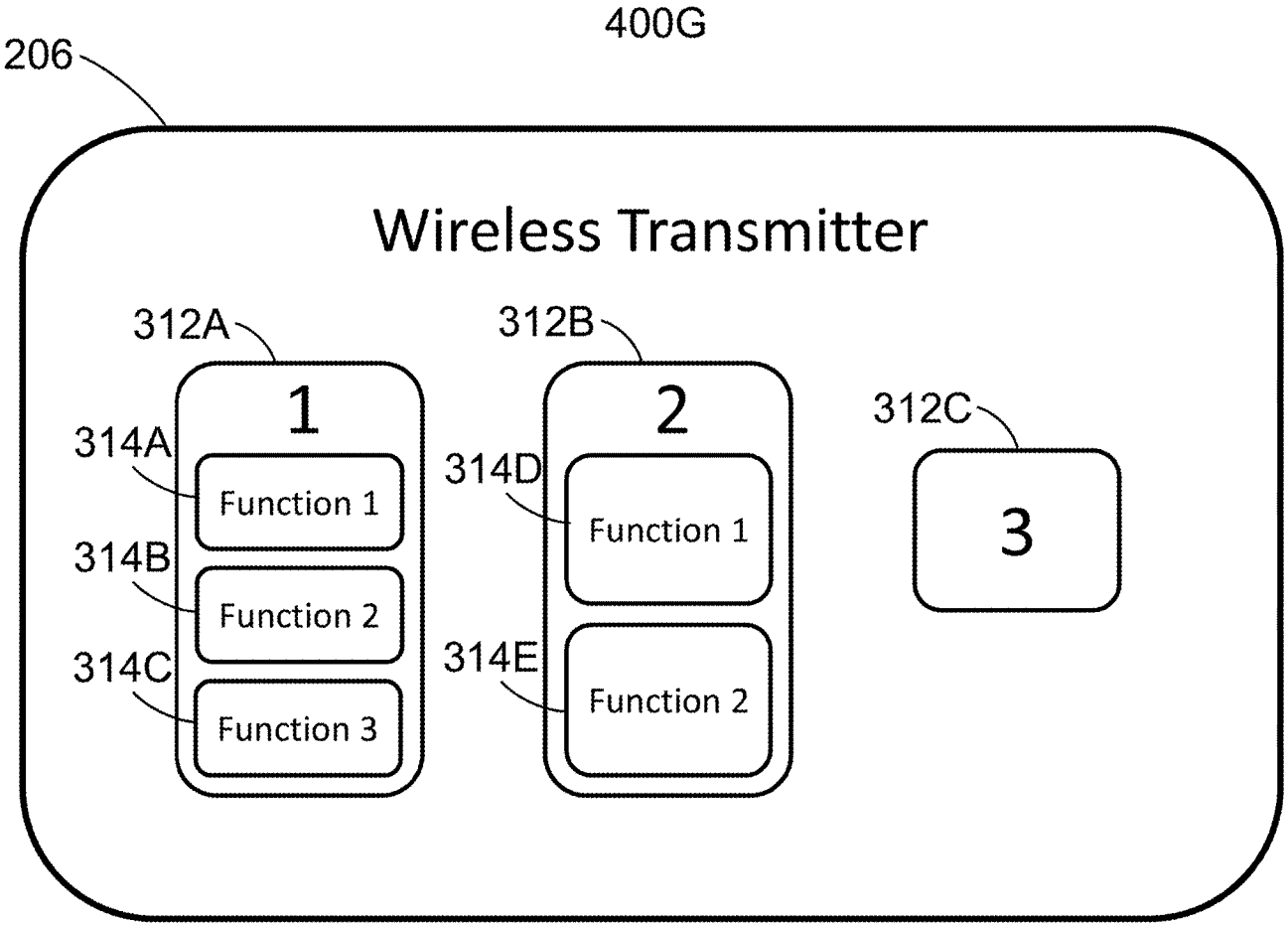

FIG. 4G illustrates another configuration 400G for the user interface element 208. In configuration 400G, the five soft keys 314A-314E may include generic names in the form of "Function N." The first container element 312A may include three soft keys 314A-314C to actuate or control three functions for a remote device. The second container element 312B may include two soft keys 314D and 314E corresponding to actuate or control two functions for the same remote device or another remote device. The third container element 312C may itself be a soft key.

Figure 5:
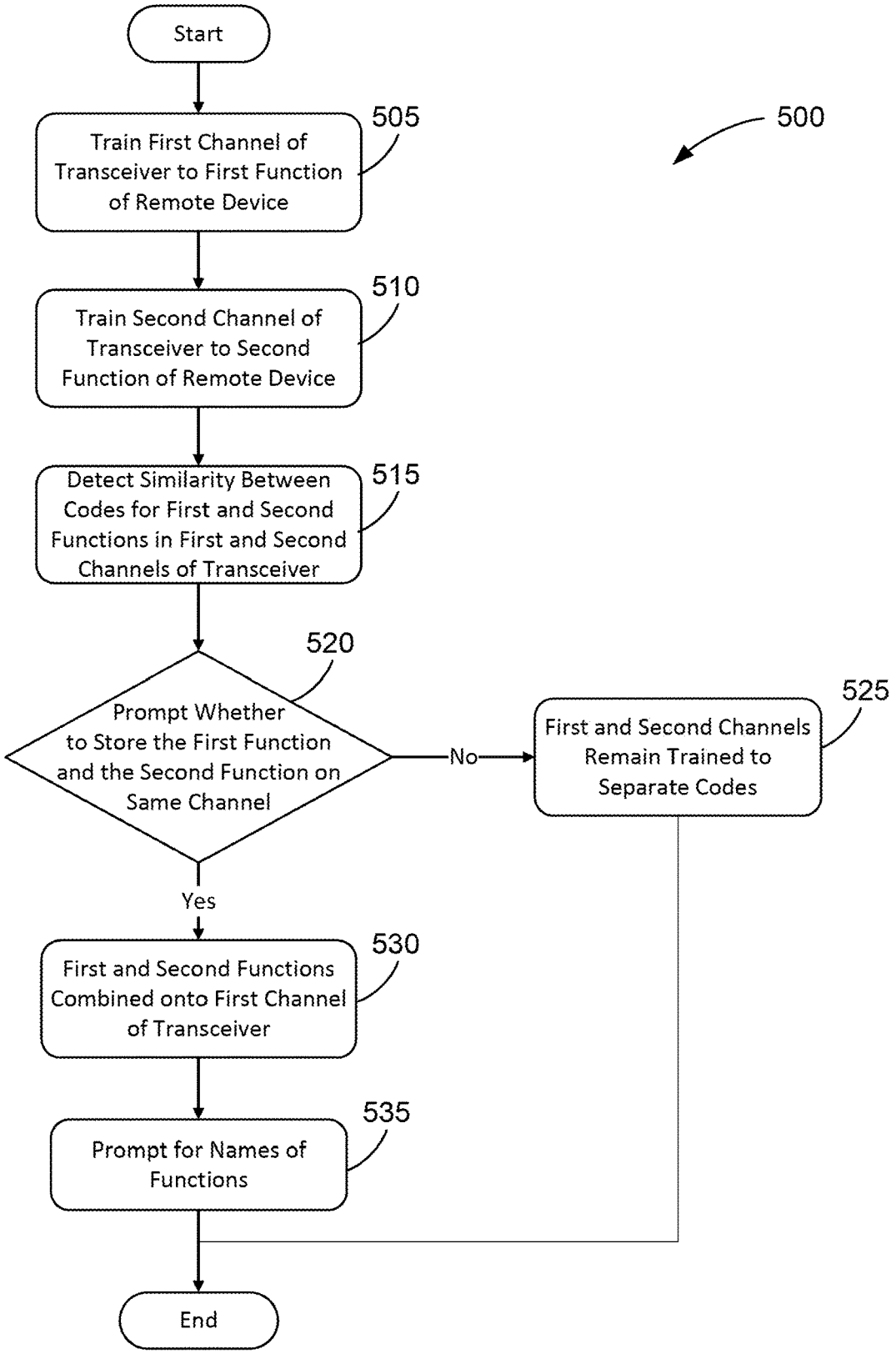
FIG. 5 is a flow diagram of an method of selectively transmitting commands associated with a single channel, according to an illustrative embodiment.

Referring now to FIG. 5, a method 500 of selectively transmitting commands associated with a single channel is shown, according to an illustrative embodiment. The method 500 may be performed using various components and/or modules detailed herein, such as the trainable transceiver 102 as described in conjunction with FIGS. 2 and 3. The method 500 may correspond to a scenario when the trainable transceiver is training to at least two functions for controlling the remote device.

At step 505, the trainable transceiver may train a first channel of the trainable transceiver to a first function of a remote device. In some embodiments, the trainable transceiver may receive a first message from an original transmitter used to control the remote device. The trainable transceiver may analyze the first message to obtain control information for the first function. The trainable transceiver may then save the control information (or code) for the first function to the first channel.

At step 510, the trainable transceiver may train a second channel of the trainable transceiver to a second function of the remote device. In some embodiments, the trainable transceiver may receive a second message from the original transmitter used to control the remote device. The second message may be part of the same control signal as the first message. The trainable transceiver may analyze the second message to obtain control information for the second function. The trainable transceiver may then save the control information (or code) for the second function to the second channel.

At step 515, the trainable transceiver may detect a similarity between the code for the first function in the first channel and the code for the second function in the second channel. In some embodiments, the trainable transceiver may determine whether the first message is similar to the second message based on any number of characteristics. Examples of characteristics may include a time duration, a binary code, an encryption information (e.g., a rolling code, rolling code seed, look ahead codes, secret key, fixed code, or other information related to an encryption technique), among others.

At step 520, the trainable transceiver may prompt whether to store the first function and the second function on the same channel. In some embodiments, the trainable transceiver may display the prompt for storing the first function and the second function on the same channel through a user interface element, responsive to detecting the similarity. The prompt may include an affirmative response for storing the two functions onto the same channel and/or a negative response for storing the two functions at separate channels.

At step 525, if the response to the prompt is negative, the trainable transceiver may maintain the first channel trained to the first function and the second channel trained to the second function. In some embodiments, the trainable transceiver may save the control information for the first function in the first channel and the control information for the second function in the second channel. The first function may appear on a container element different from the second function on the user interface element.

At step 530, if the response to the prompt is positive, the trainable transceiver may combine the first function and the second function onto the first channel. In some embodiments, the trainable transceiver may move or transfer the control information for the first function and the control information for the second function into the same channel. The first function may appear as a first soft key and the second function may appear as a second soft key in the same container element associated with the channel. By managing memory in this manner, the trainable transceiver may allow for additional functionalities (e.g., controlling more functions or more remote devices) at the user interface element.

At step 535, the trainable transceiver may prompt for the names of the functions. In some embodiments, the trainable transceiver may display on the electronic display of the user interface element for the names of the soft keys associated with the stored function. The prompt may include a keyboard (e.g., QWERTY keyboard) to allow the operator of the trainable transceiver to enter in names for the soft keys corresponding to the stored function.

Figure 6:
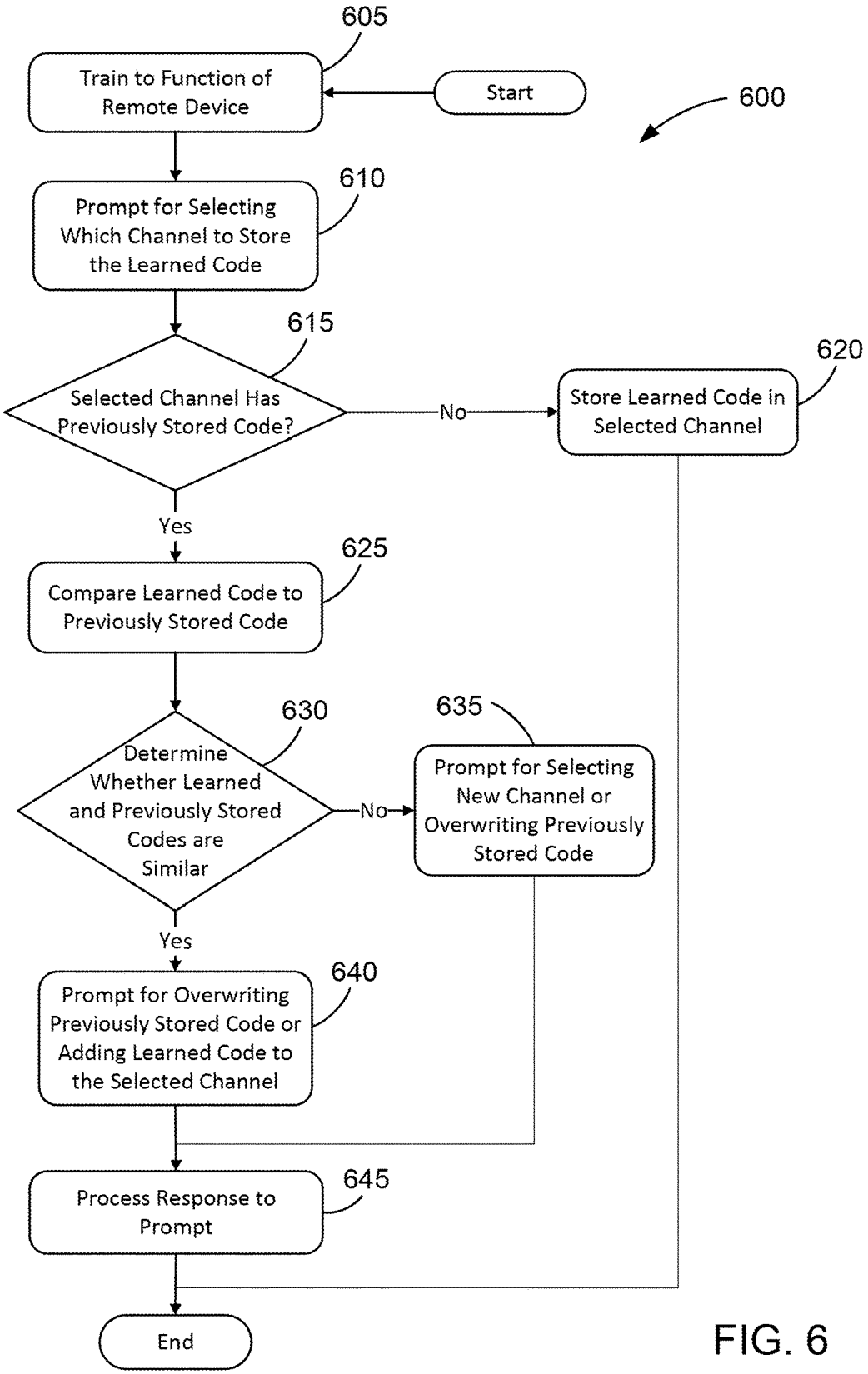
FIG. 6 is a flow diagram of a method of selectively transmitting commands associated with a single channel, according to an illustrative embodiment.

Referring now to FIG. 6, a method 600 of selectively transmitting commands associated with a single channel is shown, according to an illustrative embodiment. The method 600 may be performed using various components and/or modules detailed herein, such as the trainable transceiver 102 as described in conjunction with FIGS. 2 and 3. The method 600 may correspond to when a trainable transceiver already is trained for controlling one function of a remote device and is then trained for controlling another function of the remote device.

At step 605, the trainable transceiver may train to a function of the remote device. In some embodiments, the trainable transceiver may receive a message from an original transmitter used to control the remote device. The trainable transceiver may analyze the message to obtain control information (or code) for the function.

At step 610, the trainable transceiver may prompt for selecting which channel to store the learned code for the function. In some embodiments, the trainable transceiver may display a prompt for selecting the channel on an electronic display of a user interface element. The prompt may include an option to select one of the container elements corresponding to the channel.

At step 615, the trainable transceiver may determine whether the selected channel has previously stored code. The previously stored code may be control information for another function of the remote device. For example, the currently learned code may correspond to an unlock function at the remote device and the previously stored code may correspond to a lock function at the remote device. At step 620, if the selected channel does not have previously stored code, the trainable transceiver may store the learned code in the selected channel. In some embodiments, the trainable transceiver may transfer the learned code from one channel to the selected channel.

At step 625, if the selected channel has previously stored code, the trainable transceiver may compare the learned code to the previously stored code. At step 630, the trainable transceiver may determine whether the learned code and the previously stored code are similar. In some embodiments, the trainable transceiver may determine whether a first message for the previously stored code is similar to a second message for the currently learned code based on any number of characteristics. Examples of characteristics may include a time duration, a binary code, an encryption information (e.g., a rolling code, rolling code seed, look ahead codes, secret key, fixed code, or other information related to an encryption technique), among others.

At step 635, if the previously stored code and the learned code are not similar, the trainable transceiver may prompt for selecting a new channel or overwriting the previously stored code. In some embodiments, the trainable transceiver may display a prompt for selecting the new channel for storing the learned code through an electronic display of a user interface element. Once the new channel is selected, the trainable transceiver may store the learned code on the corresponding channel and may display a soft key at the associated container element for the learned code. In some embodiments, the trainable transceiver may display a prompt for overwriting the previously stored code. In response to an affirmative response, the trainable transceiver may overwrite the previously stored code from the channel with the learned code. The trainable transceiver may then display a soft key for the new function corresponding to the learned code at the same container element as the previously stored code.

At step 640, if the previously stored code and the learned code are similar, the trainable transceiver may prompt for overwriting the previously stored code or adding the learned code to the selected channel. In some embodiments, the trainable transceiver may display a prompt for overwriting the previously stored code. In response to an affirmative response, the trainable transceiver may overwrite the previously stored code from the selected channel with the learned code. The trainable transceiver may then display a soft key for the new function corresponding to the learned code at the same container element as the previously stored code. In response to a negative response, the trainable transceiver may prompt for adding the learned code to the selected channel. In some embodiments, the trainable transceiver may display a prompt for adding the learned code to the selected channel. In response to an affirmative response, the trainable transceiver may store the learned code at the selected channel along with the previously stored code. The trainable transceiver may then display a soft key for the new function corresponding to the learned code at the same container element as the previously stored code. In response to a negative response, the trainable transceiver may prompt for overwriting the previously stored code with the learned code. At step 645, the trainable transceiver may process the response to the prompt from step 635 or step 640.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for selectively transmitting commands associated with a single channel, comprising:

a channel configured to be trained to control one or more functions of a remote device;

an electronic display configured to display one or more container elements;

a container element of the electronic display comprising a first soft key and a second soft key, wherein the container element is associated with the channel, wherein the first soft key is configured to control a first function of the remote device, and wherein the second soft key is configured to control a second function of the remote device; and an interface module configured to set the channel to control the first function and the second function based on the determination that the first message characteristic of the first message to control the first function of the remote device is similar to the second message characteristic of the second message to control the second function of the remote device;

wherein the first and second message characteristics include at least one of a time duration, a binary code, and encryption information.

2. The trainable transceiver of claim 1, further comprising:

a comparator module configured to determine that a first message characteristic of a first message to control the first function of the remote device is similar to a second message characteristic of a second message to control the second function of the remote device.

3. The trainable transceiver of claim 1, further comprising:

a training module configured to receive, from an original transmitter, a first message associated with the first function and a second message associated with the second function; and a comparator module configured to:

parse the first message to identify a first binary code;

parse the second message to identify a second binary code; and determine that a difference between the first binary code and the second binary code is less than a threshold.

4. The trainable transceiver of claim 1, further comprising a second channel configured to control the one or more functions of the remote device; and further comprising an interface module configured to set the second function from the second channel to the first channel.

5. The trainable transceiver of claim 1, wherein the electronic display is further configured to display a prompt for associating at least one of the first function and the second function to the container element.

6. The trainable transceiver of claim 1, the container element of the electronic display is further configured to display a prompt for selecting the first function or the second function to assign to the container element.

7. The trainable transceiver of claim 1, wherein the electronic display is further configured to display a prompt to start training of the first channel of the trainable transceiver;

wherein the container element initially further comprises a third soft key; and further comprising an interface module configured to:

identify the first function and the second function of the remote device; and remove the third soft key, responsive to the identification of the first function and the second function of the remote device.

8. A method of selectively transmitting commands associated with a single channel, comprising:

training, by a trainable transceiver, using a first message from an original transmitter, a first channel of the trainable transceiver to a first function of a remote device, the first channel corresponding to a first container element on the trainable transceiver;

training, by the trainable transceiver, using a second message from the original transmitter, a second channel of the trainable transceiver to a second function of the remote device, the second channel corresponding to a second container element on the trainable transceiver, the second container element different from the first container element;

determining, by an interface module of the trainable transceiver, that a first message characteristic of the first message is similar to a second message characteristic of the second message; and setting, by the trainable transceiver, the first function and the second function to the first channel, responsive to determining that the first message characteristic of the first message is similar to the second message characteristic of the second message;

wherein the first and second message characteristics include at least one of a time duration, a binary code, and encryption information.

9. The method of claim 8, further comprising:

training, by the trainable transceiver, the second channel of the trainable transceiver to a third function of the remote device;

determining, by the trainable transceiver, that the second message characteristic of the second function is dissimilar to a third message characteristic of the third function; and setting, by the trainable transceiver, the third function to the second channel.

10. The method of claim 8, wherein detecting that the first message characteristic of the first message is similar to the second message characteristic of the second message further comprises:

receiving, from the original transmitter, a single control signal including the first message and the second message; and parsing the single signal to identify a first binary code followed by a second binary code, the first binary code corresponding to the first message, the secondary binary code corresponding to the second message.

11. The method of claim 8, wherein detecting that the first message characteristic of the first message is similar to the second message characteristic of the second message further comprises:

receiving, from the original transmitter, the first message associated with the first function and the second message associated with the second function;

parsing the first message to identify a first binary code;

parsing the second message to identify a second binary code; and determining that a difference between the first binary code and the second binary code is less than a threshold.

12. The method of claim 8, further comprising displaying, by the trainable transceiver on a display, a prompt to associate the first command and the second command onto the first channel.

13. The method of claim 8, further comprising displaying, by the trainable transceiver on a display, a prompt for the first channel to select the first function or the second function, subsequent to setting the first function and the second function to the first channel.

14. The method of claim 8, further comprising displaying, by the trainable transceiver on a display, a prompt for naming the first function and the second function for display on the first container element.

15. A method of selectively transmitting commands associated with a single channel, comprising:

identifying, by a trainable transceiver, a first channel of the trainable transceiver as set to transmit a first message for a first function of a remote device, the first channel corresponding to a first container element on the trainable transceiver;

training, by the trainable transceiver, using a second message from an original transmitter, the first channel of the trainable transceiver to a second function of the remote device;

determining, by the trainable transceiver, that the first channel is trained to the first function;

detecting, by the trainable transceiver, that a first message characteristic of the first message is similar to a second message characteristic of the second message, responsive to determining that the first channel is trained to the first function; and setting, by the trainable transceiver, the first function and the second function to the first channel, responsive to determining that the first message characteristic of the first message is similar to the second message characteristic of the second message;

wherein the first and second message characteristics include at least one of a time duration, a binary code, and encryption information.

16. The method of claim 15, further comprising:

training, by the trainable transceiver, the first channel of the trainable transceiver to a third function of the remote device;

determining, by the trainable transceiver, that the first channel is trained to the first function;

detecting, by the trainable transceiver, that the first message characteristic of the first message is dissimilar to a third message characteristic of the third control signal, responsive to determining that the first channel is trained to the first function;

displaying, by the trainable transceiver, a prompt for deleting the first function from the first channel, responsive to determining that the first message characteristic is dissimilar from the second message characteristic;

deleting, by the trainable transceiver, the first function from the first channel, responsive to the selection of the prompt; and setting, by the trainable transceiver, the third function to the first channel.

17. The method of claim 15, further comprising:

training, by the trainable transceiver, the first channel of the trainable transceiver to a third function of the remote device;

determining, by the trainable transceiver, that the first channel is trained to the first function;

detecting, by the trainable transceiver, that the first message characteristic of the first message is similar to a third message characteristic of the third control signal, responsive to determining that the first channel is trained to the first function;

determining, by the trainable transceiver, that a number of functions trained to the first channel is greater than or equal to a maximum number;

displaying, by the trainable transceiver, a prompt for deleting the first function, the second function, or the third function, responsive to determining that the number of functions is greater than the threshold number.

18. The method of claim 15, wherein detecting that the first message characteristic of the first function is similar to the second message characteristic of the second function further comprises:

receiving, from the original transmitter, a single signal;

parsing the single signal to identify a first binary code followed by a second binary code, the first binary code corresponding to the first function, the secondary binary code corresponding to the second function.

19. The method of claim 15, wherein detecting that the first message characteristic of the first message is similar to the second message characteristic of the second message further comprises:

receiving, from the original transmitter, the first message associated with the first function and the second message associated with the second function;

parsing the first message to identify a first binary code;

parsing the second message to identify a second binary code; and determining that a difference between the first binary code and the second binary code is less than a threshold.

20. The method of claim 15, further comprising:

displaying, by the trainable transceiver, a prompt for selecting the first channel or the second channel for the first function of the remote device; and wherein determining that the first channel is trained to the first function further comprises determining that the first channel is trained to the first function, responsive to receiving a selection of the first channel.

* * * * *